US008334883B2

(12) United States Patent
Tin

(10) Patent No.: US 8,334,883 B2
(45) Date of Patent: Dec. 18, 2012

(54) RENDERING MULTISPECTRAL IMAGES ON REFLECTIVE DISPLAYS

(75) Inventor: Siu-Kei Tin, Milpitas, CA (US)

(73) Assignee: Canon Kabushiki Kaisha, Tokyo (JP)

( * ) Notice: Subject to any disclaimer, the term of this patent is extended or adjusted under 35 U.S.C. 154(b) by 842 days.

(21) Appl. No.: 12/494,229

(22) Filed: Jun. 29, 2009

(65) Prior Publication Data

US 2010/0328356 A1 Dec. 30, 2010

(51) Int. Cl.
*G09G 5/10* (2006.01)

(52) U.S. Cl. ..... 345/690; 345/211; 345/212

(58) Field of Classification Search ..... 345/87–98, 345/204–215, 690
See application file for complete search history.

(56) References Cited

U.S. PATENT DOCUMENTS

| | | | | | |
|---|---|---|---|---|---|
| 5,267,030 | A | * | 11/1993 | Giorgianni et al. | 358/518 |
| 5,309,256 | A | * | 5/1994 | Takada et al. | 358/504 |
| 5,345,315 | A | * | 9/1994 | Shalit | 358/406 |
| 5,521,708 | A | | 5/1996 | Beretta | 356/402 |
| 5,793,884 | A | | 8/1998 | Farrell | 382/167 |
| 6,980,231 | B1 | | 12/2005 | Ohsawa | 348/188 |
| 7,314,283 | B2 | | 1/2008 | Tsukada | 353/121 |
| 2008/0137941 | A1 | | 6/2008 | Tin | 382/162 |
| 2008/0303918 | A1 | | 12/2008 | Keithley | 348/223.1 |

OTHER PUBLICATIONS

Website, 9 pgs; Sergio Gonzalez, Evaluating the 1931 CIE Color Matching Functions "Fluorescent Database", last accessed Feb. 18, 2009 at: http://www.cis.rit.edu/mcsl/research/sgonzalez/.

* cited by examiner

*Primary Examiner* — Vijay Shankar
(74) *Attorney, Agent, or Firm* — Fitzpatrick, Cella, Harper & Scinto

(57) ABSTRACT

Image display which accesses an image containing multispectral data and a spectral device model for a reflective display. The reflective display renders the image by modulation of an ambient illuminant and is driven by color primary signals for corresponding color primaries. A spectral power distribution of a direct irradiance of a current ambient illuminant is cyclically and repetitively estimated by using a measurement of the spectral power distribution of the direct irradiance of the current ambient illuminant. Color primary signals are determined by using the estimation of the spectral power distribution of the direct irradiance of the current ambient illuminant, the spectral device model, and the multispectral image data. The reflective display is driven by the determined color primary signals, such that the multispectral image data rendered on the reflective display simulates the appearance of the multispectral image data calorimetrically under the current ambient illuminant.

46 Claims, 8 Drawing Sheets

RENDERING MULTISPECTRAL IMAGES ON REFLECTIVE DISPLAYS

FIELD

The present disclosure relates to color management of reflective displays, and more particularly relates to rendering multispectral images on reflective displays driven by a limited number of color channels.

BACKGROUND

Reflective displays belong to a class of displays called nonemissive displays which do not dominantly rely on an internal light source in order to render an image. Generally speaking, nonemissive displays render images by modulation of an ambient illuminant. More specifically, reflective displays render images by selectively reflecting an ambient illuminant currently incident on the display. Such displays are therefore different from conventional displays such as CRTs or transmissive LCDs, which are emissive, self-luminous displays that dominantly rely on a fixed, internal light source to display the image. Reflective displays are fabricated from a variety of materials and operating mechanisms, including, for example, cholesteric liquid crystal displays and electrophoretic displays.

In order to display colors, reflective displays can use an additive color model, such as a RGB color model, or a subtractive color model, such as a CMY color model. Reflective displays are driven by color primary signals which correspond to the color model being used. For example, if a reflective display uses the subtractive CMY color model, it is driven by a color primary signal corresponding to cyan, a color primary signal corresponding to magenta, and a color primary signal corresponding to yellow.

In recent years, commercial use of reflective displays has gained momentum. As one example, reflective displays have increasingly popular application in electronic paper technologies such as electronic book readers. Electronic book readers display digital books and may allow a user to download and store different documents for viewing. Due to the use of reflective displays, electronic book readers have a paper-like quality which allows a user to comfortably view a displayed document under an ambient illuminant.

SUMMARY

One difficulty encountered with reflective displays is that they are typically driven by a limited number of color primary signals and therefore cannot accurately render an image spectrally in relation to the original object. The displayed image often appears differently from the original object depending on the ambient illuminant currently used to view the reflective display.

In one example embodiment, the foregoing situation is addressed in a display apparatus that cyclically and repetitively estimates a spectral power distribution (SPD) of a direct irradiance of a current ambient illuminant incident on the reflective display and determines the color primary signals for driving the reflective display by using the estimation of the SPD of the direct irradiance of the current ambient illuminant, a spectral device model for the reflective display, and multispectral data comprising an image.

Thus, in an example embodiment described herein, an image is rendered on a display apparatus by accessing an image containing multispectral data and a spectral device model for a reflective display. The reflective display renders the image by modulation of an ambient illuminant. Furthermore, the reflective display is driven by color primary signals for corresponding color primaries of the reflective display. An estimation of a SPD of a direct irradiance of a current ambient illuminant is cyclically and repetitively determined by using a measurement of the SPD of the direct irradiance of the current ambient illuminant. The color primary signals are determined by using all of the estimation of the SPD of the direct irradiance of the current ambient illuminant, the spectral device model of the reflective display, and the multispectral image data, such that the multispectral image data rendered on the reflective display simulates the appearance of the multispectral image data calorimetrically under the current ambient illuminant.

By virtue of deriving color primary signals for driving the reflective display at the current ambient illuminant, rendering of multispectral image data on the reflective display may be improved such that the appearance of displayed image colors match the appearance of original object colors when viewed under changing ambient illuminants.

By virtue of using a reflective display which renders the image by modulation of an ambient illuminant, rendering of the multispectral image data on the reflective display may be improved such that the appearance of displayed image colors may simulate the appearance of the original object colors when viewed under the same ambient illuminant because there may not be a dominant internal light source to alter the image viewing conditions. In addition, power consumption may be reduced because the image may be displayed without consuming power and there may be no need to provide power to an internal light source. Moreover, the comfort level of an observer may be increased because the reflective display may have a wide viewing angle and glare may be reduced.

In an example embodiment, a current colorimetric device model of the reflective display is calculated at the current ambient illuminant by using the estimation of the SPD of the direct irradiance of the current ambient illuminant and the spectral device model. In this example embodiment, color primary signals for driving the reflective display are determined by using all of the current colorimetric device model of the reflective display, the estimation of the SPD of the direct irradiance of the current ambient illuminant, and the multispectral image data.

In another example embodiment, an inversion algorithm is applied to the current colorimetric device model of the reflective display to generate a current inverse colorimetric device model of the reflective display. Current colorimetric image values corresponding to the multispectral image data at the current ambient illuminant are calculated by using the estimation of the SPD of the direct irradiance of the current ambient illuminant and the multispectral image data. In this case, color primary signals for driving the reflective display are determined by using both of the current inverse colorimetric device model of the reflective display and the current colorimetric image values. In some embodiments, the current inverse colorimetric device model for the reflective display is calculated only once for the entirety of image before being used by the controller to determine the color primary signals for each pixel of the image.

In still other example embodiments, if the spectral device model of the reflective display is linear and the multispectral data comprises spectral reflectance factors, the spectral device model is separated into (i) a spectral device model coefficient matrix which is to be used together with the estimation of the SPD of the direct irradiance of the current ambient illuminant, and (ii) a spectral device model offset which is not to be used together with the estimation of the SPD of the direct irradiance of the current ambient illuminant. Typically, the spectral device model offset will correspond to the white point or the black point of the reflective display, depending on whether a subtractive or additive color model is used. A multiplier is calculated by using the estimation of the SPD of the direct irradiance of the current ambient illuminant and the spectral device model coefficient matrix. According to this example embodiment, color primary signals for driving the reflective display are determined by using all of the multiplier, the spectral device model offset, and the multispectral image data.

In some example embodiments, iterative measurements of the SPD of the direct irradiance of the current ambient illuminant are performed at successive time intervals to generate a time profile of the SPD of the direct irradiance of the ambient illuminant, and the time profile of the SPD of the direct irradiance of the ambient illuminant is used to determine an estimation of the SPD of the direct irradiance of the current ambient illuminant. In other embodiments, a low pass filter in the temporal domain is applied to the time profile of the SPD to obtain a temporally smoothed SPD, and the temporally smoothed SPD of the direct irradiance of the ambient illuminant is used as an estimation of the SPD of the direct irradiance of the current ambient illuminant.

According to one example embodiment, a SPD measuring device is provided on or near a housing of the reflective display, such that the SPD measuring device measures the direct irradiance of the current ambient illuminant incident on the reflective display.

According to some example embodiments, a SPD measuring device measures the SPD of the direct irradiance of the current ambient illuminant at multiple narrow wavelength bands.

According to other example embodiments, the spectral device model relates multispectral data to the color primary signals driving the reflective display.

In an example embodiment, the SPD of the direct irradiance of the current ambient illuminant is cyclically and repetitively estimated at a time interval. The time interval is predesignated at a value that is small relative to persistence of the human visual system, so that changes in the ambient illuminant are detected and flicker of the reflective display is avoided.

In some cases, the SPD is determined by regularly sampling the direct irradiance of the current ambient illuminant at a first wavelength sampling interval, and the accessed multispectral image data is provided at a second wavelength sampling interval that differs from the first. In such a case, example embodiments use the first and second wavelength sampling intervals to determine a common wavelength sampling interval for both the SPD and the multispectral image data, which is followed by data sub-sampling such as interpolation.

According to one embodiment, the reflective display is driven by a windowing operating system that displays images in windows, and the multispectral image data to be rendered on the reflective display is provided in one window but not in others of the reflective display.

In some example embodiments, the multispectral image data comprises spectral reflectance factors. In other embodiments, the multispectral image data comprises bispectral radiance factors. In other example embodiments, the multispectral image data comprises coefficients corresponding to a set of spectral basis functions.

This brief summary has been provided so that the nature of this disclosure may be understood quickly. A more complete understanding can be obtained by reference to the following detailed description and to the attached drawings.

DETAILED DESCRIPTION

Figure 1:
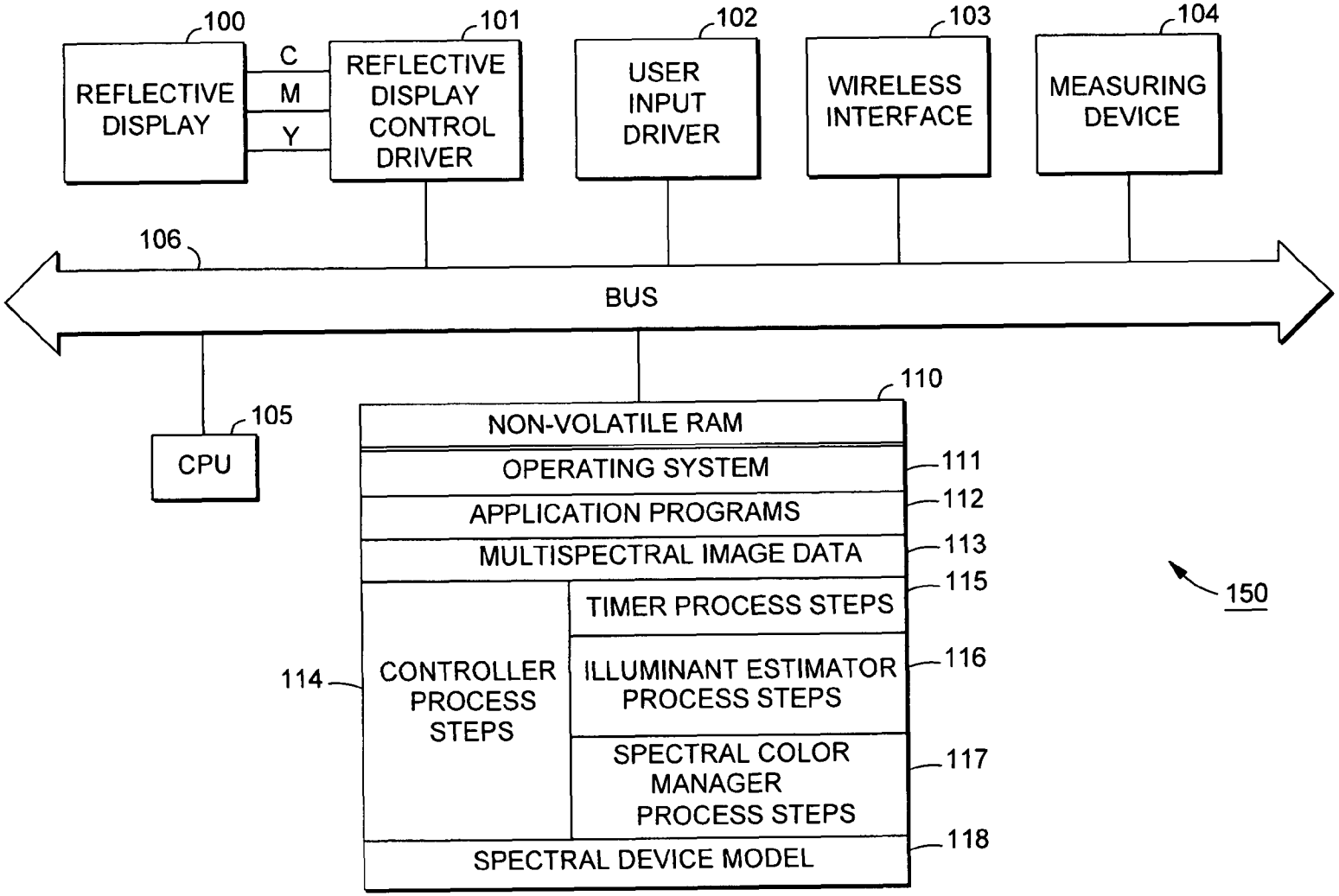
FIG. 1 is a detailed block diagram depicting the internal architecture of a display apparatus relevant to one example embodiment.

FIG. 1 is a detailed block diagram depicting the internal architecture of a display apparatus 150 relevant to one example embodiment. As shown in FIG. 1, the display apparatus includes central processing unit (CPU) 105 which interfaces with bus 106. Also interfacing with bus 106 are reflective display control driver 101 for reflective display 100, user input driver 102, wireless interface 103, measuring device 104, and non-volatile random access memory (RAM) 110.

Reflective display 100 is a nonemissive display such as an electrophoretic display which renders an image by modulation of an ambient illuminant currently incident on the display. In the alternative, reflective display 100 may be any suitable type of predominantly nonemissive display, including a cholesteric liquid crystal display, or transflective display in the reflective mode.

Reflective display control driver 101 interfaces with bus 106 so as to provide control of image rendering on reflective display 100 through color primary signals for corresponding color primaries. More specifically, each pixel of reflective display 100 is driven by color primary signals provided by CPU 105 through bus 106.

It can be appreciated that while reflective display 100 uses the subtractive CMY color model in this example embodiment, reflective display 100 may be driven by color primary signals corresponding to other color models, such as the additive RGB color model.

Wireless interface 103 provides access to information such as multispectral image data, computer-executable process steps and applications, from a remote computer or network. Of course, information such as image data may be acquired from other sources such as a storage medium or an input device. In this regard, other devices for accessing information stored on removable or remote media may also be provided, such as a USB flash drive connected to a USB port (not shown).

Measuring device 104 is provided so as to determine the spectral power distribution (SPD) of a direct irradiance of a current ambient illuminant by measuring the direct irradiance of the current ambient illuminant modulated by reflective display 100. In example embodiments, measuring device 104 predominantly measures the direct irradiance of the current ambient illuminant which is incident on the reflective display 100 and which is used by the reflective display 100 in order to display an image. Thus, stray light, such as light from an illuminant reflected by reflective display 100, are generally negligible.

The SPD of the direct irradiance of the current ambient illuminant is the amount of power per wavelength interval at a wavelength λ, where the wavelength intervals are of constant width. The SPD of the direct irradiance of the current ambient illuminant is generally measured in irradiance, in physical units of Watts per square meter per nanometer ($W.m^{-2}.nm^{-1}$). Typically, however, in order to relate calorimetric data to multispectral data, the absolute physical value of the SPD of the direct irradiance of the current ambient illuminant is not required, and it is sufficient for measuring device 104 to report a relative SPD. Accordingly, for the purposes of this disclosure, the SPD of the direct irradiance of the current ambient illuminant and the relative SPD of the direct irradiance of the current ambient illuminant are considered to be equivalent and are referred to as the SPD of the direct irradiance of the current ambient illuminant.

Measuring device 104 includes, for example, an image sensor or sensor array unit which detects the direct irradiance of the current ambient illuminant in real time. Preferably, measuring device 104 measures multiple narrow spectral bands of the SPD in the visual spectrum. Because the SPD of the direct irradiance of the current ambient illuminant typically fluctuates more than the spectral reflectance factors of the image, the wavelength sampling interval for measuring the SPD may be finer than the wavelength sampling interval for the multispectral image data that will be displayed. For example, the SPD may be determined by regularly sampling the direct irradiance of the current ambient illuminant at a wavelength sampling interval of 1 nm in a case where the wavelength sampling interval for multispectral image data is 5 nm, starting from a wavelength of 400 nm and ending at a wavelength of 700 nm.

It can be appreciated that any suitable wavelength sampling interval may be determined for measuring the SPD of the direct irradiance of the current ambient illuminant. The determination may depend on the available hardware and the sophistication of computing resources. If the wavelength sampling interval for measuring the SPD of the direct irradiance of the current ambient illuminant is different than the wavelength sampling interval for the multispectral image data, a smaller common wavelength sampling interval is determined for both the SPD and the multispectral image data, which is followed by a data sub-sampling process such as interpolation. In the simplest case, the wavelength sampling interval for measuring the SPD and the multispectral image data may be the same, such that interpolation is unnecessary.

As also shown in FIG. 1, non-volatile RAM 110 contains computer-executable operating steps for operating system 111 and application programs 112, such as web browsing programs, graphic image management programs or image display programs. In addition, data such as multispectral image data 113 and spectral device model 118 are stored in non-volatile RAM 110.

Multispectral image data 113 is a rectangular array of pixels associated with multispectral data. In some embodiments, multispectral image data 113 comprises spectral reflectance factors. A spectral reflectance factor $S_{x,y}(\lambda)$ is the ratio of the radiance reflected from a sample surface to the incident irradiance for a wavelength λ at an image pixel location (x, y). When discussing spectral reflectance factors, reference to pixel location is often omitted so that spectral reflectance factors for an image are typically notated by the vector s(λ) for each pixel of the image.

Spectral reflectance factors of a multispectral image may be obtained using a measuring device which measures a reflected illuminant such as a spectrophotometer. A predetermined sampling of N wavelengths, typically in the visible spectrum, is used such that the spectral reflectance factors form a vector with N components. For example, in some embodiments, spectral reflectance factors are sampled regularly at a 5 nm wavelength sampling interval beginning at a wavelength of 400 nm and ending at a wavelength of 700 nm, so that N=61. It can be appreciated that any suitable sampling can be used. For example, other embodiments begin sampling at a different first wavelength (e.g. 380 nm), some embodiments stop sampling at a different last wavelength (e.g. 780 nm), and still other embodiments use a different sampling wavelength interval (e.g. 10 nm).

In other embodiments, multispectral image data 113 comprises bispectral radiance factors. A bispectral radiance factor for a pixel location of the image is the ratio of radiance at a wavelength λ to irradiance at a wavelength μ, where irradiance at excitation wavelength μ causes radiance at a different emission wavelength λ. This occurs when, for example, fluorescence is present. Fluorescence is common in printed material due to the use of whitener on paper stock. However, fluorescence of a display surface may be rare.

Bispectral radiance factors of a multispectral image may be obtained by using a bispectral measuring device such as a double monochromator. Typically, a predetermined sampling of N wavelengths in the visible spectrum is used. Thus, when reference to pixel location is omitted, as above, bispectral radiance factors are represented by an N×N matrix s(μ, λ), sometimes called a Donaldson matrix, for each pixel of the image. In the case where fluorescence is not present, the bispectral radiance factors form a diagonal matrix in which the main diagonal constitutes the spectral reflectance factors and all off-diagonal elements of the matrix are zero.

In still other embodiments, multispectral image data 113 comprises coefficients corresponding to a set of spectral basis functions $b_1, b_2, \ldots, b_N$. The spectral basis functions may be either spectral reflectance factors or bispectral radiance factors. According to this embodiment, each spectral reflectance factor or bispectral radiance factor is represented as a linear combination of spectral basis functions $s_1b_1+s_2b_2+\ldots+S_Nb_N$. As a result, the amount of multispectral image data 113 is reduced which in turn reduces the amount of bandwidth needed for transmission. More specifically, for example, spectral reflectance factors may be recovered from only a set of coefficients if the spectral basis functions are stored or transmitted in advance. In this case, an 8-dimensional vector of spectral basis coefficients may encode nearly the same information as a 61-dimensional vector of spectral reflectance factors.

As previously mentioned, non-volatile RAM 110 also stores spectral device model 118. Spectral device model 118 defines the relation between spectral reflectance data and color primary signals used to drive reflective display 100. Typically, the spectral device model 118 defines a mapping from the color primary signals to the spectral reflectance of the resulting color on the display. Spectral device model 118 may be determined by using any suitable model fitting technique. For example, a sensing device such as a spectrophotometer may be used to measure the spectral reflectance of different color primary signal combinations in order to obtain data for fitting a device model of reflective display 100.

Non-volatile RAM 110 stores computer-executable process steps 114 for execution by CPU 105, so as to implement a controller for display apparatus 150. The controller process steps 114 include process steps for a timer 115, process steps for an illuminant estimator 116, and process steps for a spectral color manager 117. The individual functions of timer 115, illuminant estimator 116 and spectral color manager 117 will be discussed in more detail with respect to FIG. 2, below. In general, controller process steps 114 comprise computer-executable process steps executed by CPU 105 for managing image display on reflective display 100. The computer-executable process steps of controller 114 calorimetrically render multispectral image data 113 on reflective display 100 using an estimate of the SPD of the direct irradiance of the current ambient illuminant, as measured from measuring device 104, by deriving color primary signals corresponding to color primaries of the reflective display. More specifically, controller 114 accepts spectral device model 118 for reflective display 100, accepts an image containing multispectral image data 113, cyclically and repetitively estimates a spectral power distribution of the direct irradiance of the current ambient illuminant by using the output of measuring device 104, and determines color primary signals based on the estimation of the spectral power distribution of the direct irradiance of the current ambient illuminant, spectral device model 118, and multispectral image data 113.

It should be noted that the computer-executable process steps for controller 114 may be configured as a part of operating system 111, as part of a device driver such as reflective display control driver 101, or as a stand-alone application program. Furthermore, in addition to being implemented as a part of the display apparatus, the process steps for controller 114 may be stored and implemented separately from the display apparatus. For example, controller 114 may be stored and executed on a remote computer which is wirelessly connected through wireless interface 103 to display apparatus 150. Or, display apparatus 150 may include an application-specific integrated circuit (ASIC) which implements controller 114.

Non-volatile RAM 110 interfaces with bus 106 so as to provide information stored in non-volatile RAM 110 to CPU 105 during execution of the instructions in software programs, such as operating system 111, application programs 112, controller 114 and device drivers. For example, CPU 105 executes process steps comprising controller 114 in order to determine color primary signals. The determined color primary signals are provided to CPU 105 which in turn provides them to reflective display control driver 101 in order to drive reflective display 100.

Figure 2:
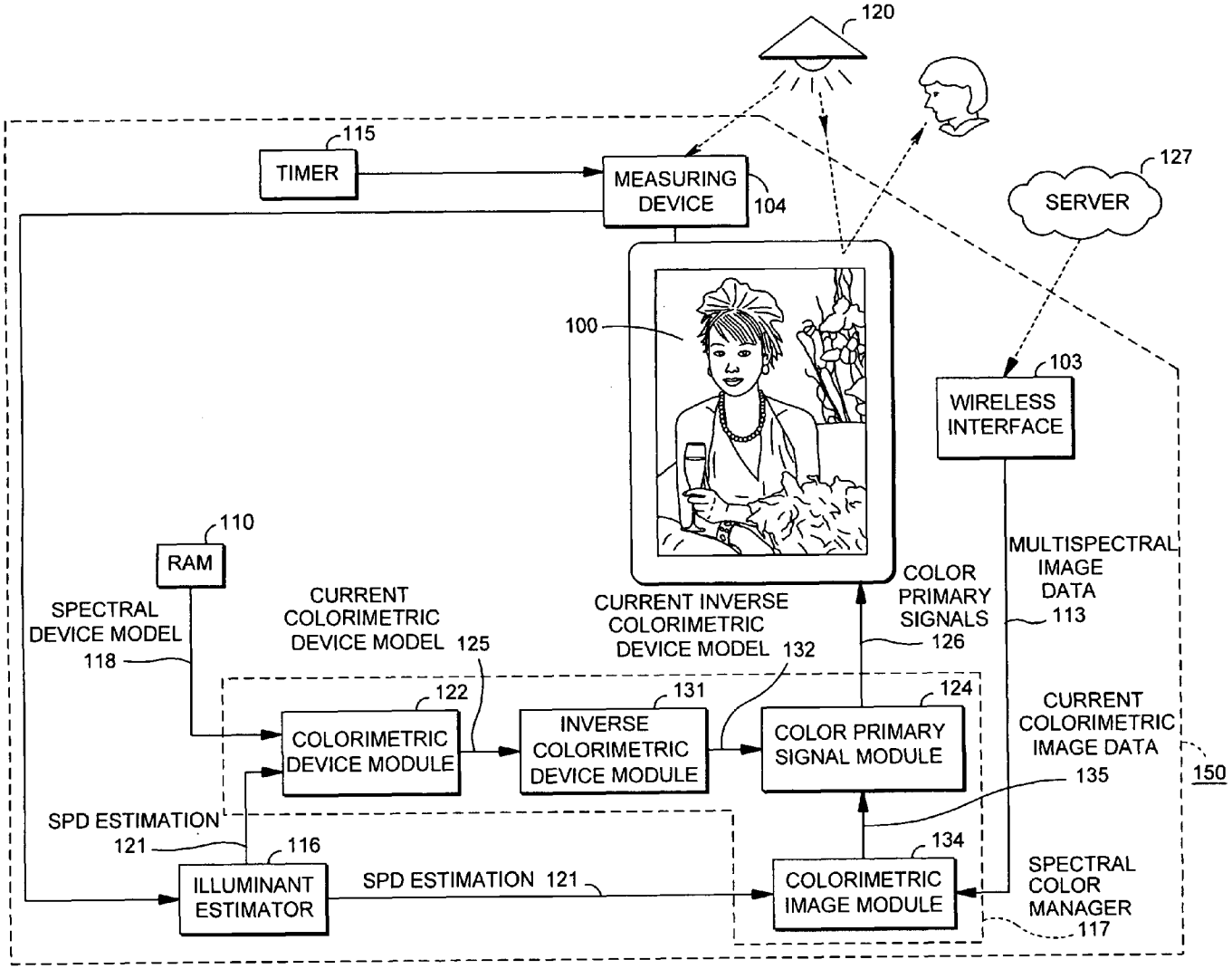
FIG. 2 is a representative view of the display apparatus shown in FIG. 1.

FIG. 2 is a representative view of the display apparatus 150 shown in FIG. 1. As shown in FIG. 2, display apparatus 150 obtains multispectral image data 113 for an image from server 127 through wireless interface 103. Display apparatus 150 renders the image on reflective display 100 by modulation of current ambient illuminant 120. It should be noted that while FIG. 2 depicts an image rendered on the entire surface of reflective display 100, in other embodiments the operating system 111 may be a windowing operating system that displays images in windows such that the image is rendered spectrally in one window, but not necessarily in others.

As previously discussed, measuring device 104 is provided to determine the SPD of the direct irradiance of current ambient illuminant 120. As shown in FIG. 2, measuring device 104 is preferably provided near or on a housing of reflective display 100, such that current ambient illuminant 120 incident on the surface of reflective display 100 is measured. In this case, light from the current ambient illuminant reflected by reflective display 100 does not reach measuring device 104 and thus is not measured by measuring device 104.

As also previously mentioned, controller process steps 114 stored in non-volatile RAM 110 for execution by CPU 105 include computer-executable process steps to implement timer 115, illuminant estimator 116 and spectral color manager 117. Process steps for timer 115 are executed by CPU 105 so as to invoke measuring device 104 to perform iterative measurements of the direct irradiance of the current ambient illuminant 120 at successive time intervals in order to generate a time profile of the SPD of the direct irradiance of the current ambient illuminant 120.

Computer-executable process steps for illuminant estimator 116 are stored in non-volatile RAM 110 to be executed by CPU 105 so as to process responses from measuring device 104 in order to cyclically and repetitively determine an estimation 121 of the SPD of the direct irradiance of current ambient illuminant 120, at a sufficiently high rate such that changes in current ambient illuminant 120 are detected and the reflective display 100 is refreshed sufficiently frequently to avoid a perceptible flicker, so as to provide a satisfactory viewing experience to a user. In some situations, it is desirable to cyclically and repetitively determine SPD estimation 121 at a sufficiently high rate such that an image is continuously viewed under changing ambient illuminants and the user's viewing experience is uninterrupted. For example, the rate for cyclically and repetitively estimating the SPD of the direct irradiance of current ambient illuminant may be at a frequency of 25 Hz or higher. In other example embodiments, the rate for cyclically and repetitively estimating the SPD of the direct irradiance of current ambient illuminant corresponds exactly to the time interval at which timer 115 invokes measuring device 104 to perform measurements of the direct irradiance of the current ambient illuminant 120. In the case that measuring device 104 does not measure the SPD directly, or the sensor responses do not correspond directly to narrow bands of wavelength, a matrix conversion is applied to each measuring device response to convert the response into SPD. The matrix transformation relates each response triggered by timer 115 to SPD in order to generate a time profile of the SPD of the direct irradiance of current ambient illuminant 120.

Figure 3:
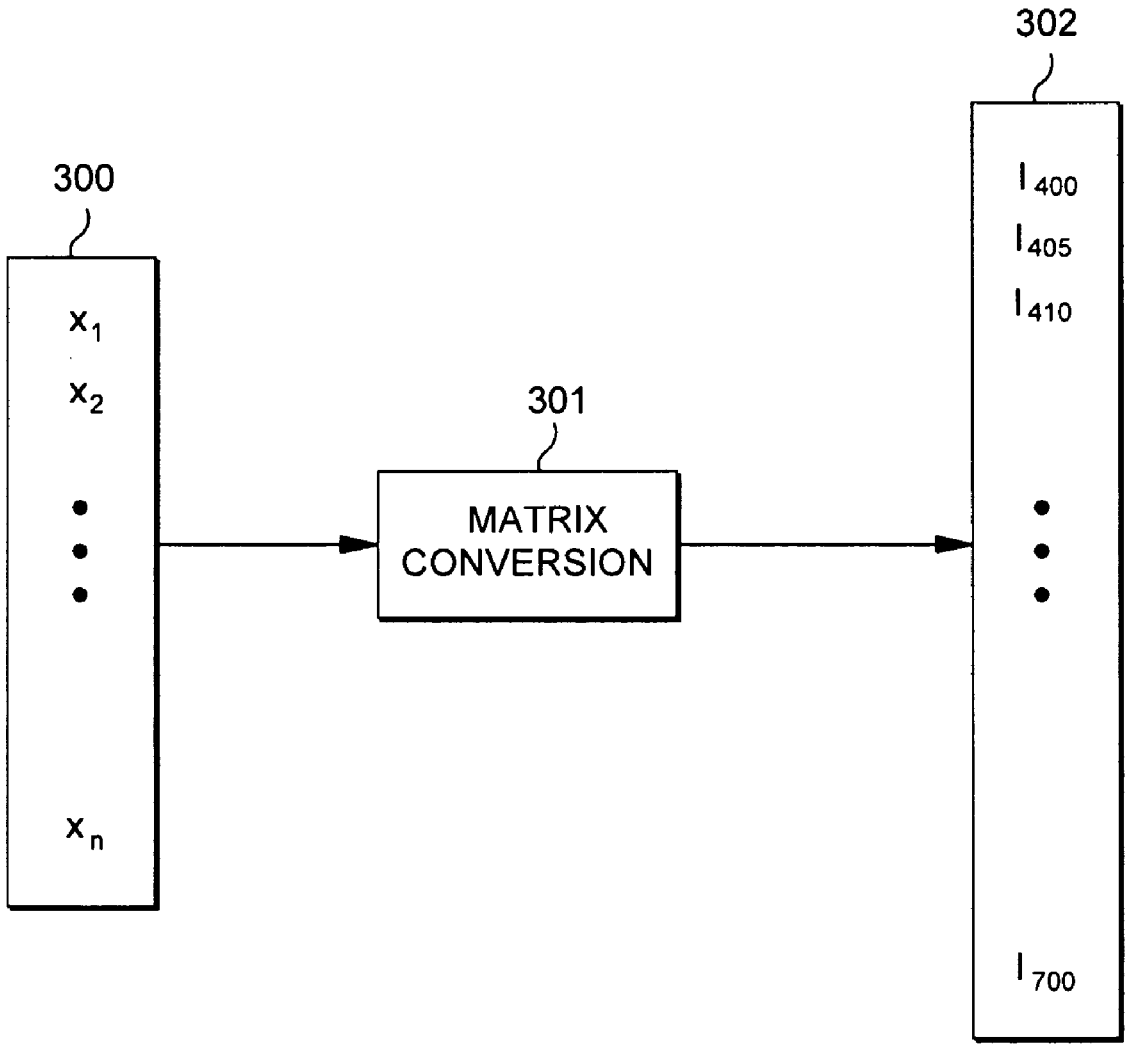
FIG. 3 is a representational view for explaining conversion of measuring device responses according to an example embodiment.

FIG. 3 is a representational view for explaining conversion of responses from measuring device 104. As shown in FIG. 3, matrix conversion 301 is applied to measuring device responses 300 in order to generate the estimation of the SPD of the direct irradiance of the current ambient illuminant 302 as a function of wavelength. The matrix conversion is determined by characterizing measuring device 104 through a model fitting process similar to that described above with respect to spectral device model 118. In some embodiments, this characterization is previously determined. For example, many sensors are characterized at the time of manufacture.

Returning to FIG. 2, CPU 105 also executes computer-executable process steps stored in non-volatile RAM 110 so as to implement illuminant estimator 116 in order to cyclically and repetitively estimate the SPD of the direct irradiance of current ambient illuminant 120. In some embodiments, the SPD estimation 121 is determined by applying a low pass filter in the temporal domain to the time profile of the SPD. As a result of applying the temporal low pass filter, temporary fluctuations in the ambient illuminant are reduced. For example, measuring device 104 responses may be averaged over an interval of time based on previous measurements, and the average values may be used to obtain a temporally smoothed SPD. For example, measurements may be averaged over the previous one second interval.

Computer-executable process steps which implement spectral color manager 117 are stored in non-volatile RAM 110 to be executed by CPU 105 so as to process SPD estimation 121 determined by illuminant estimator 116 in order to determine color primary signals for driving reflective display 100.

As shown in FIG. 2, in this embodiment, the process steps for spectral color manager 117 include computer-executable process steps which implement a calorimetric device module 122, an inverse calorimetric device module 131, a calorimetric image module 134 and a color primary signal module 124. Process steps for calorimetric device module 122 are executed by CPU 105 in order to calculate calorimetric device model 125 at the current ambient illuminant by using spectral device model 118 obtained from non-volatile RAM 110 and SPD estimation 121 obtained from illuminant estimator 116. Colorimetric device model 125 maps color primary signals 126 for driving reflective display 100 to calorimetric data.

CPU 105 executes process steps for inverse calorimetric device module 131 in order to calculate a current inverse calorimetric device model 132 at the current ambient illuminant by applying a model inversion to current calorimetric device model 125. Inverse calorimetric device module 131 may use any suitable inversion algorithm to calculate current inverse calorimetric device model 132, including an iterative algorithm such as Newton's method of numerical analysis. Current inverse calorimetric device model 132 maps calorimetric data to color primary signals 126 for driving reflective display 100.

Process steps which implement calorimetric image module 134 are executed by CPU 105 in order to calculate calorimetric image data 135 at the current ambient illuminant by using SPD estimation 121 provided by illuminant estimator 116 and multispectral image data 113. Multispectral image data 113 is accessed by calorimetric image module 134 through wireless interface 103. Colorimetric image data 135 is the calorimetric data corresponding to multispectral image data 113 at the current ambient illuminant.

CPU 105 executes computer-executable process steps for color primary signal module 124 so as to calculate color primary signals 126 for driving reflective display 100. In this first example embodiment, color primary signal module 124 derives color primary signals 126 by using both of current colorimetric image data 135 provided by colorimetric image module 134 and current inverse colorimetric device model 132 provided by inverse colorimetric device module 131.

In more detail, spectral model 118 is defined by a function F which maps from device space to spectral space, so as to give spectral reflectance values r(λ) when display 100 is driven by color primary signals 124. If the reflective display uses a subtractive CMY color model, for example, then spectral device model 118 is generally defined by the following relationship, F(c, m, y), which in this example embodiment gives spectral reflectance values r(λ) when display 100 is driven by (c, m, y) values corresponding to cyan, magenta and yellow color primary signals:

$$\begin{pmatrix} r_{400} \\ r_{405} \\ \vdots \\ r_{700} \end{pmatrix} = F(c, m, y) \tag{1}$$

where F(c, m, y) defines spectral device model 118, and $r(\lambda)=r_{400}, r_{405}, \ldots, r_{700}$ are spectral reflectance values that result when display 100 is driven by a given (c, m, y) signal.

In the case that spectral model 118 is linear, for example when reflective display 100 modulates light linearly, spectral device model 118 is characterized by a matrix R and a vector $R_0$, in the following relationship:

$$F(c, m, y) = R\begin{pmatrix} c \\ m \\ y \end{pmatrix} + R_0 \tag{2}$$

Typically, $R_0$ defines the white point for the CMY color model. On the other hand, $R_0$ typically defines the black point for the RGB color model.

When CPU 105 executes the process steps for calorimetric device module 122, spectral device model 118 and SPD estimation 121 are used to calculate current calorimetric device model 125 which is defined by a function G which maps from device space to calorimetric space at the current ambient illuminant. In this embodiment, calorimetric space is CIEXYZ space, and the current calorimetric device model 125 is defined by the following relationship G(c, m, y, t) which accepts (c, m, y) values corresponding to color primary signals for driving reflective display 100 in order to provide calorimetric data (X, Y, Z) at the current ambient illuminant at current time t:

$$G(c,m,y,t)=C(t)\cdot F(c,m,y) \tag{3}$$

where G(c, m, y, t) defines current calorimetric device model 125,

F(c, m, y) is defined above, and

C(t) is a matrix characterizing the standard human observer at the current ambient illuminant, which varies with time t, and is defined mathematically as $$C(t) = \begin{pmatrix} \bar{x}_{400}\bar{I}_{400}(t) & \bar{x}_{405}\bar{I}_{405}(t) & \ldots & \bar{x}_{700}\bar{I}_{700}(t) \\ \bar{y}_{400}\bar{I}_{400}(t) & \bar{y}_{405}\bar{I}_{405}(t) & \ldots & \bar{y}_{700}\bar{I}_{700}(t) \\ \bar{z}_{400}\bar{I}_{400}(t) & \bar{z}_{405}\bar{I}_{405}(t) & \ldots & \bar{z}_{700}\bar{I}_{700}(t) \end{pmatrix},$$

where $\bar{I}_\lambda(t)$ is SPD estimation 121, and $\bar{x}_\lambda$, $\bar{y}_\lambda$, $\bar{z}_\lambda$ are color matching functions, such as those for the standard CIE 2-degree Standard Observer.

Color matching functions model the spectral sensitivities of an average human observer and are commonly used to relate multispectral data to calorimetric data.

In the case of equation (2) where the spectral device model 118 is linear, current calorimetric device model 125 is defined by the following relationship which maps color primary signals (c, m, y) to calorimetric data (X, Y, Z) under the current ambient illuminant at time t:

$$G(c, m, y, t) = C(t)\cdot\left[R\begin{pmatrix} c \\ m \\ y \end{pmatrix} + R_0\right] \tag{4}$$

where G(c, m, y, t), C(t), R and $R_0$ are defined above.

CPU 105 executes process steps stored in non-volatile RAM 110 in order to implement inverse calorimetric device module 131 to generate inverse calorimetric device model 132 at the current ambient illuminant by applying an inversion algorithm to current calorimetric device model 125. In this embodiment, current inverse calorimetric device model 132 is defined by the following relationship, H(X, Y, Z, t), which maps calorimetric data (X, Y, Z) to (c, m, y) color primary signals for driving reflective display 100:

$$H(X,Y,Z,t)=G^{-1}(X,Y,Z,t) \tag{5}$$

where H(X, Y, Z, t) defines current inverse calorimetric device model 132 and is calculated as an inverse to equation (3).

In the case that the spectral model is linear, current inverse calorimetric device model 132 is defined by the following relationship mapping calorimetric data (X, Y, Z) to color primary signals (c, m, y):

$$H(X, Y, Z, t) = [C(t)\cdot R]^{-1}\left\{\begin{pmatrix} X \\ Y \\ Z \end{pmatrix} - C(t)\cdot R_0\right\} \tag{6}$$

where H(X, Y, Z, t), C(t), R and $R_0$ are defined above.

In other embodiments, current inverse calorimetric device model 132 may be computed only once for the entirety of the image before being used to determine color primary signals for driving reflective display 100 for each pixel of the image.

CPU 105 executes process steps for calorimetric image module 134 in order to calculate current calorimetric image data 135 corresponding to multispectral image data 113 at the current ambient illuminant. Current calorimetric image data 135 is calculated by using the following equation, J(s(λ),t), which accepts multispectral image data s(λ) in order to generate current calorimetric image data (X, Y, Z):

$$J(s(\lambda),t) \tag{7}$$

where J(s(λ), t) defines a function for determining current calorimetric image data 135 at the current ambient illuminant.

It can be appreciated that although s(λ) is used to represent multispectral image data 113 in equation (7) for convenience, any suitable type of multispectral image data may be provided to J(s(λ),t) for conversion to current calorimetric image data 135. For example, if multispectral image data 113 comprises bispectral radiance factors, the bispectral radiance factors, s(μ, λ), are provided to equation (7) in order to calculate current calorimetric image data 135. In such a case, equation (7) would be defined as J(s(μ, λ), t). The specialized forms of equation (7) for various example types of multispectral image data are given below by equations (8) through (11).

In the case that multispectral image data 113 comprises spectral reflectance factors, s(λ), equation (7) takes the following specialized form, which accepts the spectral reflectance factors, s(λ), of multispectral image data 113 in order to provide corresponding calorimetric data (X, Y, Z) at the current ambient illuminant:

$$J(s(\lambda), t) = C(t)\cdot\begin{pmatrix} s_{400} \\ s_{405} \\ \vdots \\ s_{700} \end{pmatrix} \tag{8}$$

where $S_{400}$, $S_{405}$, . . . , $S_{700}$ are the spectral reflectance factors of multispectral image data 113, and C(t) is defined above.

If multispectral image data 113 comprises bispectral radiance factors, s(μ,λ), equation (7) takes the following specialized form, which accepts the bispectral radiance factors, s(μ, λ), of multispectral image data 113 in order to generate corresponding calorimetric data (X, Y, Z) at the current ambient illuminant:

$$J(s(\mu, \lambda), t) = \begin{pmatrix} \bar{x}_{400} & \bar{x}_{405} & \cdots & \bar{x}_{700} \\ \bar{y}_{400} & \bar{y}_{405} & \cdots & \bar{y}_{700} \\ \bar{z}_{400} & \bar{z}_{405} & \cdots & \bar{z}_{700} \end{pmatrix}\begin{pmatrix} s_{400,400} & \cdots & s_{400,700} \\ \vdots & \ddots & \vdots \\ s_{700,400} & \cdots & s_{700,700} \end{pmatrix}\begin{pmatrix} \bar{I}_{400}(t) \\ \bar{I}_{405}(t) \\ \vdots \\ \bar{I}_{700}(t) \end{pmatrix} \tag{9}$$

where $S_{400,400}$, . . . ,$S_{700,700}$ are the bispectral radiance factors of multispectral image data 113, and $\bar{I}_\lambda(t)$ and $\bar{x}_\lambda$, $\bar{y}_\lambda$, $\bar{z}_\lambda$ are defined above.

In the case that multispectral image data 113 comprises coefficients corresponding to a set of spectral basis functions, there are two possible sub-cases. In the first sub-case where the spectral basis functions are spectral reflectance factors, equation (7) takes the following specialized form, which accepts coefficients for the spectral reflectance factors of multispectral image data 113 in order to generate corresponding colorimetric data (X, Y, Z) at the current ambient illuminant:

$$J(s(\lambda), t) = C(t)\cdot(b_1 \vdots \ldots \vdots b_N)\cdot\begin{pmatrix} s_1 \\ s_2 \\ \vdots \\ s_N \end{pmatrix} \tag{10}$$

where C(t) is defined above, $s_1, \ldots, s_N$ are the coefficients for the spectral reflectance factors of the multispectral image data 113, and $b_1, \ldots, b_N$ are the spectral basis functions.

In the second sub-case where the spectral basis functions are bispectral radiance factors, equation (7) takes the following specialized form, which accepts coefficients for the bispectral radiance factors of multispectral image data 113 in order to generate corresponding calorimetric data (X, Y, Z) at the current ambient illuminant:

$$J(s(\lambda), t) = \sum_{i=1}^{N} s_i\begin{pmatrix} \bar{x}_{400} & \bar{x}_{405} & \cdots & \bar{x}_{700} \\ \bar{y}_{400} & \bar{y}_{405} & \cdots & \bar{y}_{700} \\ \bar{z}_{400} & \bar{z}_{405} & \cdots & \bar{z}_{700} \end{pmatrix}\cdot b_i\cdot\begin{pmatrix} \bar{I}_{400}(t) \\ \bar{I}_{405}(t) \\ \vdots \\ \bar{I}_{700}(t) \end{pmatrix} \tag{11}$$

where $\bar{I}_\lambda(t)$ and $\bar{x}_\lambda$, $\bar{y}_\lambda$, $\bar{z}_\lambda$ are defined above, $s_1, \ldots, s_N$ are the coefficients for the bispectral radiance factors of the multispectral image data 113, and $b_1, \ldots, b_N$ are the spectral basis functions.

In example embodiments of the second sub-case, the factors which are independent of time and image may be precomputed and stored in advance. Such factors may include terms $$\begin{pmatrix} \bar{x}_{400} & \bar{x}_{405} & \cdots & \bar{x}_{700} \\ \bar{y}_{400} & \bar{y}_{405} & \cdots & \bar{y}_{700} \\ \bar{z}_{400} & \bar{z}_{405} & \cdots & \bar{z}_{700} \end{pmatrix}\cdot b_i$$

from equation (11).

CPU 105 executes process steps for color primary signal module 124 in order to determine color primary signals 126 for each pixel of the rendered image by using current calorimetric image data 135 represented generally by equation (7) and current inverse calorimetric device model 132 defined generally in equation (5), such that the rendering of multispectral image data 113 on the reflective display simulates the appearance of the multispectral image data calorimetrically under the current ambient illuminant. More specifically, in the case that multispectral image data 113 comprises spectral reflectance factors, color primary signals 126 for each pixel of the rendered image are determined by providing current calorimetric image data 135 output from equation (8) to current inverse calorimetric device model 132, given by equation (5) in the general case and equation (6) in the special case of a linear spectral device model.

In the case that the multispectral image data comprises bispectral radiance factors, color primary signals 126 for each pixel of the rendered image are determined by providing current calorimetric image data 135 output from equation (9) to current inverse calorimetric device model 132, given by equation (5) in the general case and equation (6) in the special case of a linear spectral device model.

In the case that the multispectral image data comprises coefficients corresponding to a set of spectral basis functions, color primary signals 126 for each pixel of the rendered image are determined by providing current calorimetric image data 135 output from equation (10) or (11) (depending on the sub-case) to the current inverse calorimetric device model 132, given by equation (5) in the general case and equation (6) in the special case of a linear spectral device model.

It can be appreciated that while the subtractive CMY model has been used as an example in the above description, reflective display 100 may also use an additive color model such as the RGB model. In this case, the color primary signals for driving reflective display 100 would correspond to the red, green and blue channels of the RGB color model. In addition, it should be noted that although calorimetric data comprises CIEXYZ data in this example embodiment, any suitable representation of calorimetric data may be used.

Figure 4:
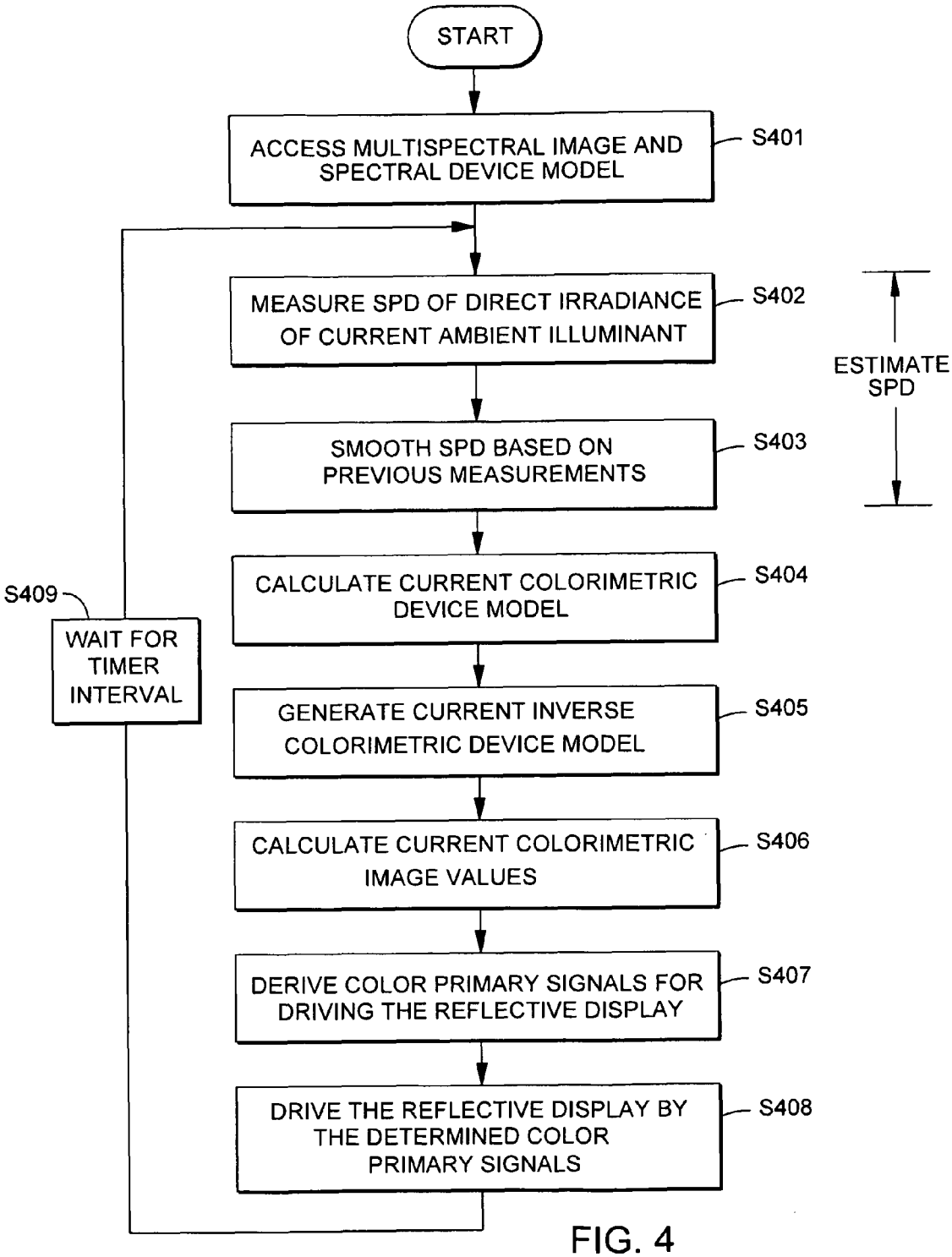
FIG. 4 is a flow diagram for explaining an image display process according to one example embodiment.

FIG. 4 is a flow diagram for explaining image display on a display apparatus according to this example embodiment. The process steps shown in FIG. 4 are executed by CPU 105 based on controller process steps 114 stored in non-volatile RAM 110. As shown in FIG. 4, at step S401 spectral device model 118 and an image containing multispectral image data 113 are accessed.

In steps S402 and S403 an estimation 121 of the SPD of the direct irradiance of the current ambient illuminant is obtained. At step S402, the SPD of the direct irradiance of current ambient illuminant 120 is measured by measuring device 104. The flow then proceeds to step S403 in which the SPD of the direct irradiance of the current ambient illuminant is temporally smoothed based on previous measurements from measuring device 104, as previously discussed with respect to FIG. 2.

At step S404 current calorimetric device model 125 is calculated by using SPD estimation 121 and spectral device model 118. In step S405, current inverse calorimetric device model 132 is generated by applying an inversion algorithm to current calorimetric device model 125. In step S406, values for current calorimetric image data 135 corresponding to multispectral image data 113 at the current ambient illuminant are calculated by using SPD estimation 121 and multispectral image data 113.

The process then flows to step S407 where color primary signals 126 for driving reflective display 100 are determined by using current inverse calorimetric device model 132 and current calorimetric image data 135. Color primary signals 126 are determined for each pixel of the image rendered on reflective display 100 corresponding to multispectral image data 113 at the current ambient illuminant.

In step S408, reflective display 100 is driven by color primary signals 126, such that multispectral image data 113 rendered on reflective display 100 simulates the appearance of the multispectral image data calorimetrically under the current ambient illuminant. At the end of step S408, the process flows to step S409, in which display apparatus 150 waits for a time interval determined by timer 115 before returning to step S402, such that color primary signals 126 for driving reflective display 100 are determined based on the cyclic and repetitive estimation 121 of the SPD.

Figure 5:
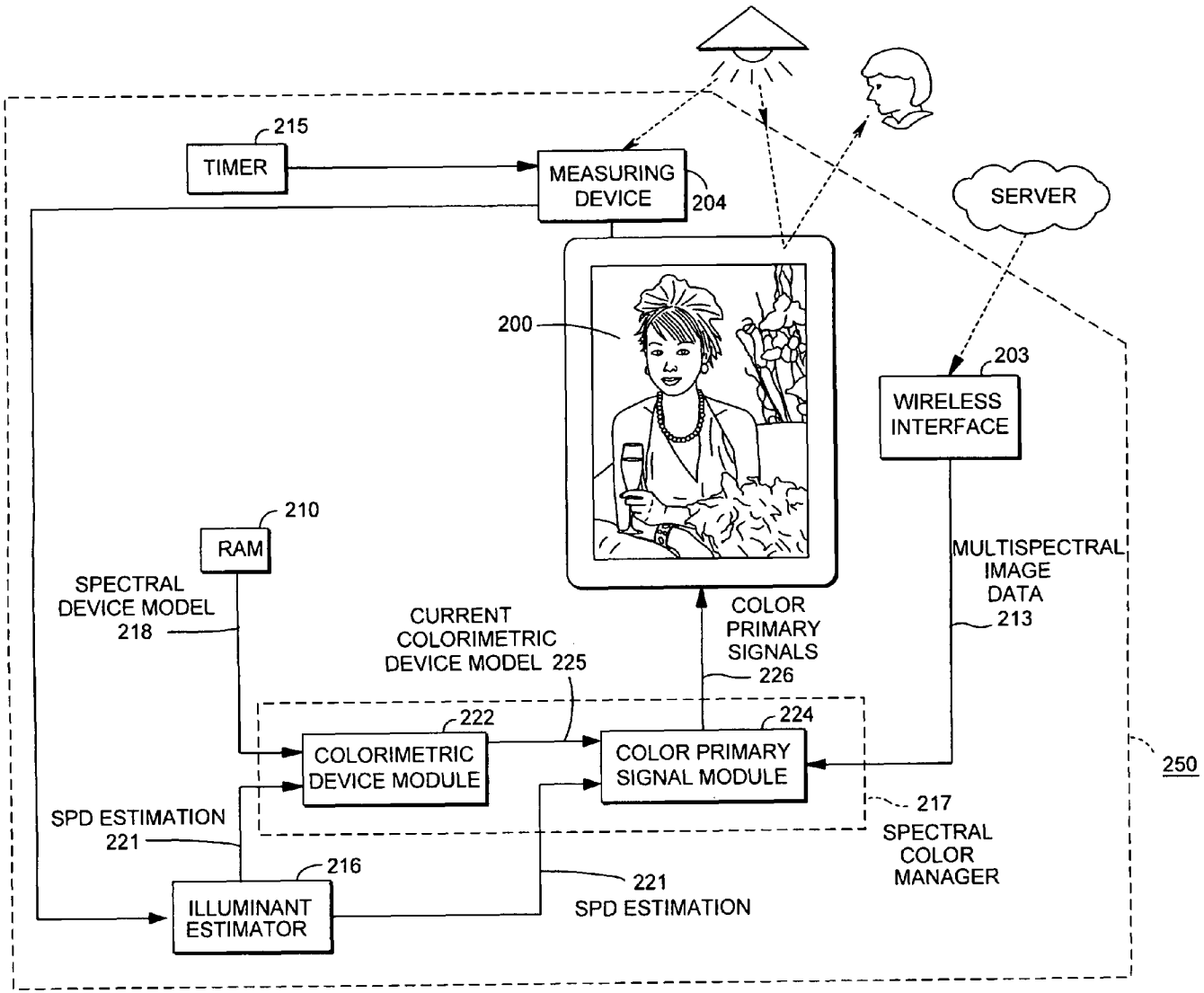
FIG. 5 is a representative view of a display apparatus according to a second example embodiment.

FIG. 5 is a representative view of a display apparatus according to a second example embodiment. One way that this second embodiment differs from the first embodiment is in the construction of the spectral color manager. In particular, in the second example embodiment, the spectral color manager combines the equations for the current inverse calorimetric device model and the current calorimetric image data into a composite equation such that the current calorimetric image data does not need to be calculated separately at the current ambient illuminant. Accordingly, the multispectral image data may be directly supplied to the color primary signal module in order to derive color primary signals for driving the reflective display.

The internal architecture of display apparatus 250 shown in FIG. 5 is similar to that of display apparatus 150 depicted in FIG. 1. Thus, display apparatus 250 includes a central processing unit (CPU) which is similar in operation to CPU 105. The CPU of display apparatus 250 interfaces with a bus which is similar in operation to bus 106. Also interfacing with this bus are a reflective display control driver which is similar in operation to reflective display control driver 101 for reflective display 200, a user input driver which is similar in operation to user input driver 102, a wireless interface 203 which is similar in operation to wireless interface 103, a measuring device 204 which is similar to measuring device 104, and a non-volatile RAM 210 which is similar to non-volatile RAM 110. Accordingly, elements of display apparatus 250 which perform similar respective functions to the elements of display apparatus 150 have been designated with similar reference characters for convenience. In addition, a detailed description of such elements has been omitted.

Thus, display apparatus 250 includes a non-volatile RAM 210 which stores computer-executable process steps for execution by the CPU so as to implement a controller for display apparatus 250. The process steps for the controller include process steps for a timer 215 and an illuminant estimator 216, in addition to computer-executable process steps for a spectral color manager 217.

As shown in FIG. 5, in this second embodiment, the process steps stored in non-volatile RAM 210 which implement spectral color manager 217 include computer-executable process steps for a calorimetric device module 222 and a color primary signal module 224 when executed by the CPU. Similar to the first embodiment, process steps for calorimetric device module 222 are executed by the CPU in order to calculate calorimetric device model 225 at the current ambient illuminant by using spectral device model 218 obtained from non-volatile RAM 210 and SPD estimation 221 obtained from illuminant estimator 216.

Process steps for color primary signal module 224 are executed by the CPU in order to calculate color primary signals 226 for driving reflective display 200 at the current ambient illuminant. According to this second example embodiment, color primary signals 226 are determined by color primary signal module 224 by using multispectral image data 213 obtained from wireless interface 203, SPD estimation 221 obtained from illuminant estimator 216, and current calorimetric device model 225 obtained from calorimetric device module 222. Thus, in contrast to the first embodiment, color primary signals 226 are determined by color primary signal module 224 by using multispectral image data 213 rather than a separate calculation of calorimetric image values followed by a conversion to color primary signals.

In more detail, similar to the first embodiment, if the reflective display uses a subtractive CMY color model, then spectral device model 218 is generally defined by the following relationship, F(c, m, y), which in this example embodiment gives spectral reflectance values r(λ) when display 200 is driven by (c, m, y) values corresponding to cyan, magenta and yellow color primary signals:

$$\begin{pmatrix} r_{400} \\ r_{405} \\ \vdots \\ r_{700} \end{pmatrix} = F(c, m, y) \tag{12}$$

where F(c, m, y) defines spectral device model 218, and $r_{400}, \ldots, r_{700}$ are the components of the spectral reflectance data r(λ).

As in the first embodiment, in the case that spectral device model 218 is linear, spectral device model 218 is characterized by a matrix R and a vector $R_0$, in the following relationship defining a mapping from (c, m, y) color primary signals to spectral reflectance values:

$$F(c, m, y) = R\begin{pmatrix} c \\ m \\ y \end{pmatrix} + R_0 \tag{13}$$

Typically, $R_0$ defines the white point for the CMY color model. On the other hand, $R_0$ typically defines the black point for the RGB color model.

When the CPU executes the process steps for calorimetric device module 222 stored in non-volatile RAM 210, similar to the first example embodiment, spectral device model 218 and SPD estimation 221 are used to calculate current calorimetric device model 225. Current calorimetric device model 225 is defined in this embodiment by the following relationship, G(c, m, y, t), mapping (c, m, y) values corresponding to color primary signals for driving reflective display 200 to calorimetric data (X, Y, Z) at the current ambient illuminant at time t:

$$G(c,m,y,t)=C(t)\cdot F(c,m,y) \tag{14}$$

where G(c, m, y, t) is current calorimetric device model 225,

F(c, m, y) is defined above, and

C(t) is a matrix characterizing the standard human observer at the current ambient illuminant, which varies with time t, and is defined mathematically as $$C(t) = \begin{pmatrix} \bar{x}_{400}\bar{I}_{400}(t) & \bar{x}_{405}\bar{I}_{405}(t) & \ldots & \bar{x}_{700}\bar{I}_{700}(t) \\ \bar{y}_{400}\bar{I}_{400}(t) & \bar{y}_{405}\bar{I}_{405}(t) & \ldots & \bar{y}_{700}\bar{I}_{700}(t) \\ \bar{z}_{400}\bar{I}_{400}(t) & \bar{z}_{405}\bar{I}_{405}(t) & \ldots & \bar{z}_{700}\bar{I}_{700}(t) \end{pmatrix},$$

where $\bar{I}_0(t)$ is SPD estimation 221, and $\bar{x}_\lambda$, $\bar{y}_\lambda$, $\bar{z}_\lambda$ are color matching functions, such as those for the standard CIE 2-degree Standard Observer.

As in the first embodiment, in the case that the spectral model is linear, for example when reflective display 200 modulates light linearly, current calorimetric device model 225 is defined by the following relationship mapping (c, m, y) color primary signals for driving reflective display 200 to calorimetric data (X, Y, Z):

$$G(c, m, y, t) = C(t)\cdot\left[R\begin{pmatrix} c \\ m \\ y \end{pmatrix} + R_0\right] \tag{15}$$

where G(c, m, y, t), C(t), R and $R_0$ are defined above.

The CPU executes process steps stored in non-volatile RAM 210 in order to implement color primary signal module 224 so as to determine color primary signals 226 for each pixel of the rendered image. As in the first embodiment, color primary signal module 224 determines color primary signals 226 such that a rendering of multispectral image data 213 on the reflective display simulates the appearance of multispectral image data 213 calorimetrically under the current ambient illuminant. However, in contrast to the first example embodiment, in this embodiment, color primary signal module 224 uses all of current calorimetric device model 225, SPD estimation 221, and multispectral image data 213 in order to derive the needed color primary signals 226.

More specifically, color primary signals 226 for each pixel of the rendered image are determined directly from the multispectral image data 213, the SPD estimation 221, and the current calorimetric device model 225, by combining together equations which were applied separately in the first embodiment. In the first embodiment, the inverse of the current calorimetric device model was defined as H(X, Y, Z, t), and current calorimetric image data was calculated separately using the equation J(s(λ), t). In this second embodiment, these two equations are combined together into a single function K, as follows:

$$K(s(\lambda),t)=H(J(s(\lambda),t)) \tag{16}$$

where equation (16) provides (c, m, y) color primary signals 226 for driving display 200 directly from multispectral image data s(λ) under the current ambient illuminant at time t.

As shown by equation (16), in contrast to the first example embodiment, color primary signal module 224 calculates color primary signals for driving reflective display 200 by using multispectral image data 213 as input rather than calorimetric image values at the current ambient illuminant.

As previously discussed, although s(λ) is used to represent multispectral image data 213 in equation (16) for convenience, any suitable type of multispectral image data may be provided to K(s(λ), t) in order to derive color primary signals. The specific forms of equation (16) for various example types of multispectral image data are given below by equations (17) through (20).

In the case that the spectral model is linear and the multispectral image data comprises spectral reflectance factors, equation (16) takes the following specialized form, which accepts the spectral reflectance factors of multispectral image data 213 in order to derive color primary signals for driving reflective display 200:

$$K(s(\lambda), t) = [C(t)\cdot R]^{-1}C(t)\left\{\begin{pmatrix} s_{400} \\ s_{405} \\ \vdots \\ s_{700} \end{pmatrix} - R_0\right\} \tag{17}$$

where C(t), R, $R_0$, and $S_{400}, \ldots, S_{700}$ are defined above.

In the case that the spectral model is linear and the multispectral image data comprises bispectral radiance factors, equation (16) takes the following specialized form, which accepts bispectral radiance factors s(μ, λ) of multispectral image data 113 in order to generate color primary signals (c, m, y) at the current ambient illuminant:

$$K(s(\mu,\lambda),t) = [C(t)\cdot R]^{-1}\left\{\begin{pmatrix}\bar{x}_{400} & \bar{x}_{405} & \dots & \bar{x}_{700}\\ \bar{y}_{400} & \bar{y}_{405} & \dots & \bar{y}_{700}\\ \bar{z}_{400} & \bar{z}_{405} & \dots & \bar{z}_{700}\end{pmatrix}\begin{pmatrix}s_{400,400} & \dots & s_{400,700}\\ \vdots & \ddots & \vdots\\ s_{700,400} & \dots & s_{700,700}\end{pmatrix}\begin{pmatrix}\bar{I}_{400}(t)\\ \bar{I}_{405}(t)\\ \vdots\\ \bar{I}_{700}(t)\end{pmatrix} - C(t)R_0\right\} \tag{18}$$

where C(t), R, $R_0$, $\bar{x}_\lambda$, $\bar{y}_\lambda$, $\bar{z}_\lambda$, $\bar{I}_\lambda(t)$, and $s_{400,400}, \dots, S_{700,700}$ are defined above.

In the case that multispectral image data comprises coefficients corresponding to a set of spectral basis functions, there are two possible sub-cases. In the first sub-case where the spectral basis functions are spectral reflectance factors, equation (16) takes the following specialized form, which accepts coefficients corresponding to spectral reflectance factors $s_1, \dots, s_N$ of multispectral image data 213 in order to calculate color primary signals (c, m, y) at the current ambient illuminant, if the spectral model is linear:

$$K(s(\lambda),t) = [C(t)\cdot R]^{-1}C(t)\left\{(b_1 \vdots \dots \vdots b_N)\cdot\begin{pmatrix}s_1\\ s_2\\ \vdots\\ s_N\end{pmatrix} - R_0\right\} \tag{19}$$

where C(t), R, $R_0$, $b_1, \dots, b_N$, and $s_1, \dots, s_N$ are defined above.

In the second sub-case where the spectral basis functions are bispectral radiance factors, equation (16) takes the following specialized form, accepting coefficients corresponding to bispectral radiance factors $s_1, \dots, s_N$ of multispectral image data 213 to derive color primary signals (c, m, y) at the current ambient illuminant, if the spectral device model is linear:

$$K(s(\lambda),t) = [C(t)\cdot R]^{-1}\left\{\sum_{i=1}^{N} s_i\begin{pmatrix}\bar{x}_{400} & \bar{x}_{405} & \dots & \bar{x}_{700}\\ \bar{y}_{400} & \bar{y}_{405} & \dots & \bar{y}_{700}\\ \bar{z}_{400} & \bar{z}_{405} & \dots & \bar{z}_{700}\end{pmatrix}\cdot b_i\cdot\begin{pmatrix}\bar{I}_{400}(t)\\ \bar{I}_{405}(t)\\ \vdots\\ \bar{I}_{700}(t)\end{pmatrix} - C(t)R_0\right\} \tag{20}$$

where C(t), R, $R_0$, $\bar{x}_\lambda$, $\bar{y}_\lambda$, $\bar{z}_\lambda$, $\bar{I}_\lambda(t)$, $b_1, \dots, b_N$, $s_1, \dots, s_N$ are defined above.

As noted above with respect to other embodiments, while the subtractive CMY model has been used as an example in the above description, reflective display 200 may also use an additive color model such as the RGB model. It should also be noted that although calorimetric data comprises CIEXYZ data in this illustrative embodiment, any suitable representation of calorimetric data may be used.

Figure 6:
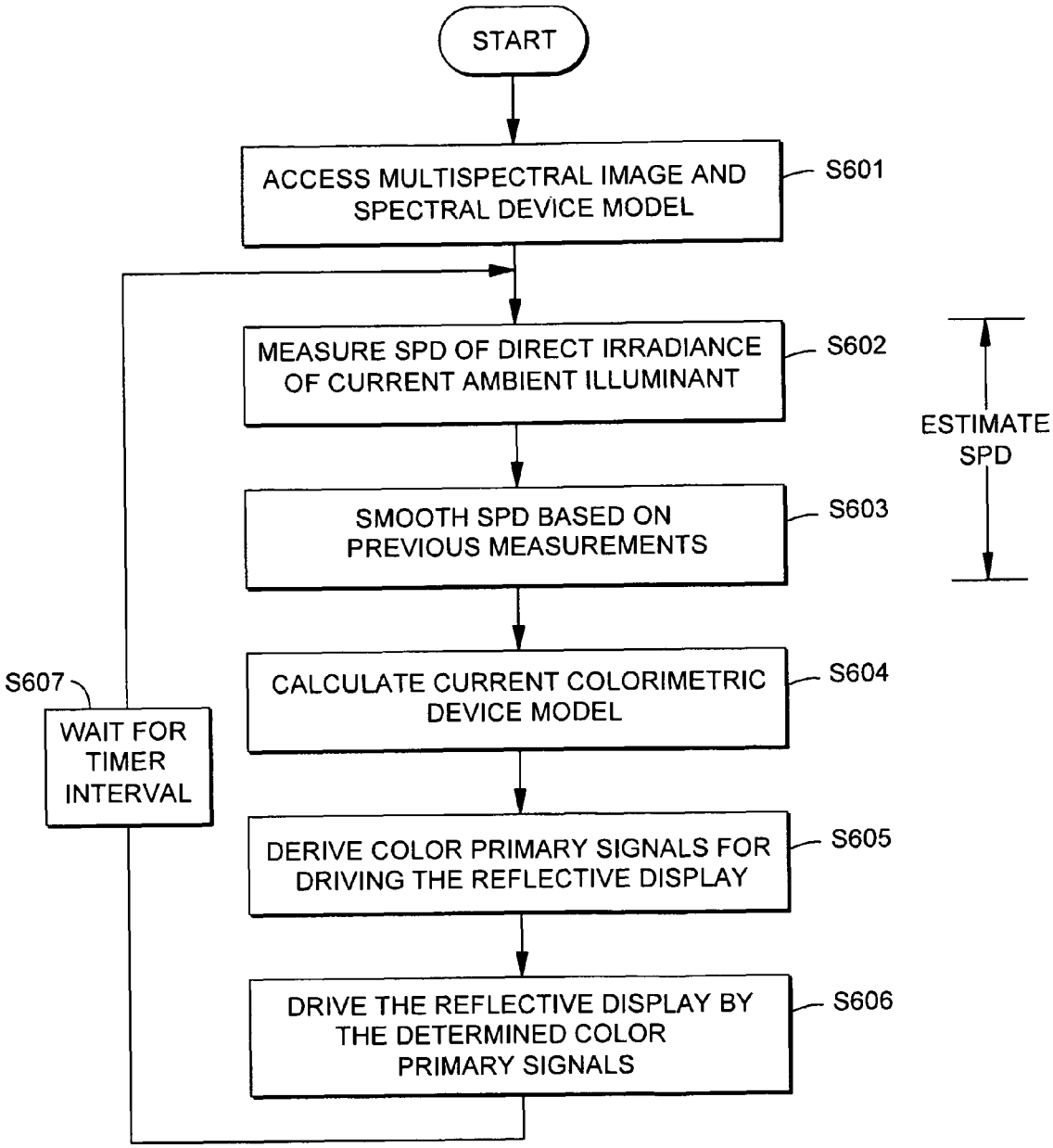
FIG. 6 is a flow diagram for explaining an image display process according to a second example embodiment.

FIG. 6 is a flow diagram for explaining image display on a display apparatus according to a second example embodiment. The process steps shown in FIG. 6 are executed by the CPU based on controller process steps stored in RAM 210. As shown in FIG. 6, at step S601 spectral device model 218 and an image containing multispectral image data 213 are accessed.

In steps S602 and S603 an estimation 221 of the SPD of the direct irradiance of the current ambient illuminant (SPD estimation 221) is obtained. At step S602, the SPD of the direct irradiance of the current ambient illuminant is measured by measuring device 204. The flow then proceeds to step S603 in which the SPD of the direct irradiance of the current ambient illuminant is temporally smoothed based on previous measurements from measuring device 204.

At step S604 calorimetric device model 225 is calculated at the current ambient illuminant by using SPD estimation 221 and spectral device model 218. In step S605, color primary signals 226 for driving reflective display 200 are determined by using current calorimetric device model 225, SPD estimation 221, and multispectral image data 213. Color primary signals 226 are determined for each pixel of the image rendered on reflective display 200 corresponding to multispectral image data 213 at the current ambient illuminant.

The process then flows to step S606 in which reflective display 200 is driven by color primary signals 226, such that multispectral image data 213 rendered on reflective display 200 simulates the appearance of multispectral image data 213 under the current ambient illuminant. At the end of step S606, the flow proceeds to step S607, in which display apparatus 250 waits for a time interval determined by timer 215 before returning to step S602, such that color primary signals 226 for driving reflective display 200 are determined based on the cyclic and repetitive estimation 221 of the SPD.

Figure 7:
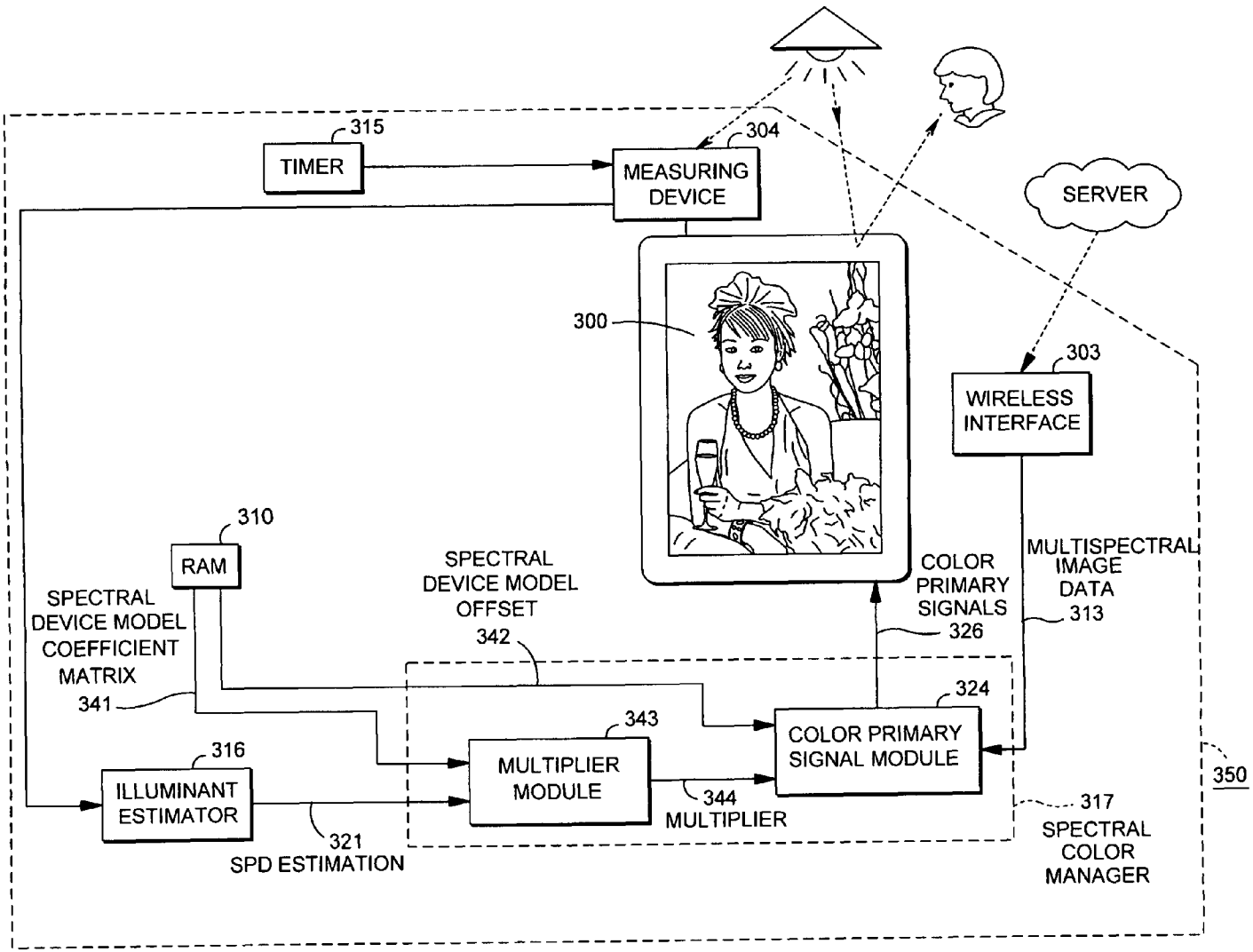
FIG. 7 is a representative view of a display apparatus according to a third example embodiment.

FIG. 7 is a representative view of a display apparatus according to a third example embodiment in which the spectral device model for the reflective display is linear and the multispectral image data comprises spectral reflectance factors and not bi-spectral reflectances. In the alternative, according to this example embodiment, the multispectral image data may also comprise coefficients corresponding to a set of basis functions representing spectral reflectance factors.

One way that this third embodiment differs from the first two is that a portion of the spectral device model which is to be used together with the estimation of the SPD of the direct irradiance of the current ambient illuminant is considered separately from a portion of the spectral device model which is not to be used together with the SPD estimation. By virtue of this configuration, when the spectral device model is linear and multispectral image data 313 comprises spectral reflectance factors, it is ordinarily possible to determine color primary signals 326 for driving reflective display 300 by providing SPD estimation 321 once, namely to multiplier module 343. In this way, multiplier 344 which depends upon SPD estimation 321 is pre-calculated and provided to color primary signal module 324, such that color primary signal module 324 need not access illuminant estimator 316 in order to obtain SPD estimation 321.

The internal architecture of display apparatus 350 shown in FIG. 7 is similar to that of display apparatus 150 depicted in FIG. 1. Thus, display apparatus 350 includes a central processing unit (CPU) which is similar in operation to CPU 105. The CPU of display apparatus 350 interfaces with a bus which is similar in operation to bus 106. Also interfacing with this bus are a reflective display control driver which is similar in operation to reflective display control driver 101 for reflective display 300, a user input driver which is similar in operation to user input driver 102, a wireless interface 303 which is similar in operation to wireless interface 103, a measuring device 304 which is similar to measuring device 104, and a non-volatile RAM 310 which is similar to non-volatile RAM 110. Accordingly, elements of display apparatus 350 which perform similar respective functions to the elements of display apparatus 150 have been designated with similar reference characters for convenience. In addition, a detailed description of such elements has been omitted.

Thus, display apparatus 350 includes a non-volatile RAM 310 which stores computer-executable process steps for execution by the CPU so as to implement a controller for display apparatus 350. The process steps for the controller include process steps for a timer 315 and an illuminant estimator 316, in addition to computer-executable process steps for a spectral color manager 317.

As shown in FIG. 7, in this example embodiment, when the spectral device model stored in non-volatile RAM 310 is linear and the multispectral image data stored in non-volatile RAM 310 comprises spectral reflectance factors, a portion of the spectral device model which is to be used together with the SPD estimation is considered separately from a portion of the spectral device model which is not to be used together with the SPD estimation. More specifically, the spectral device model is separated into spectral device model coefficient matrix 341 which is to be used together with SPD estimation 321 and spectral device model offset 342 which is not to be used together with SPD estimation 321.

The process steps stored in non-volatile RAM 310 which implement spectral color manager 317 include computer-executable process steps for a multiplier module 343 and a color primary signal module 324 when executed by the CPU. Process steps for multiplier module 343 are executed by the CPU in order to calculate multiplier 344 by using SPD estimation 321 obtained from illuminant estimator 316 and spectral device model coefficient matrix 341 obtained from non-volatile RAM 310.

Process steps for color primary signal module 324 are executed by the CPU in order to calculate color primary signals 326 for driving reflective display 300 at the current ambient illuminant. Generally, the controller for display apparatus 350 determines color primary signals for driving reflective display 300 by using all of SPD estimation 321, the spectral device model for reflective display 300, and multispectral image data 313, such that multispectral image data 313 rendered on reflective display 300 simulates the appearance of multispectral image data 313 calorimetrically under the current ambient illuminant. More specifically, in this third example embodiment, color primary signals 326 are determined by using all of multiplier 344 obtained from multiplier module 343, spectral device model offset 342 obtained from the spectral model stored in non-volatile RAM 310, and multispectral image data 313 obtained from wireless interface 303.

In more detail, in the first case where the multispectral image data comprises spectral reflectance factors and the spectral device model is linear, the spectral device model is characterized by a matrix R and a vector $R_0$, in the following relationship mapping spectral reflectance data $r(\lambda)$ to (c, m, y) color primary signals, if the reflective display uses a subtractive CMY color model:

$$\begin{pmatrix} r_{400} \\ r_{405} \\ \vdots \\ r_{700} \end{pmatrix} = R\begin{pmatrix} c \\ m \\ y \end{pmatrix} + R_0 \tag{21}$$

where $r(\lambda)=r_{400}, \ldots, r_{700}$ are spectral reflectance values that result when display 300 is driven by a given (c, m, y) signal.

Typically, $R_0$ defines the white point for the CMY color model. On the other hand, $R_0$ typically defines the black point for the RGB color model.

According to this example embodiment, when the spectral device model is linear and multispectral image data 313 comprises spectral reflectance factors, the spectral device model is separated into spectral device model coefficient matrix 341 which is to be used together with SPD estimation 321 and spectral device model offset 342 which is not to be used together with SPD estimation 321. In particular, spectral device model coefficient matrix 341 corresponds to the matrix R and spectral device model offset 342 corresponds to the vector $R_0$.

When the CPU executes the process steps for multiplier module 343 stored in non-volatile RAM 310, spectral device model coefficient matrix 341 and SPD estimation 321 are used to calculated multiplier 344 by using the following equation:

$$M(t)=[C(t)\cdot R]^{-1}C(t) \tag{22}$$

where M(t) is multiplier 344,

R is spectral device model coefficient matrix 341, and

C(t) is a matrix characterizing the standard human observer at the current ambient illuminant, which varies with time t, and is defined mathematically as $$C(t) = \begin{pmatrix} \bar{x}_{400}\bar{I}_{400}(t) & \bar{x}_{405}\bar{I}_{405}(t) & \ldots & \bar{x}_{700}\bar{I}_{700}(t) \\ \bar{y}_{400}\bar{I}_{400}(t) & \bar{y}_{405}\bar{I}_{405}(t) & \ldots & \bar{y}_{700}\bar{I}_{700}(t) \\ \bar{z}_{400}\bar{I}_{400}(t) & \bar{z}_{405}\bar{I}_{405}(t) & \ldots & \bar{z}_{700}\bar{I}_{700}(t) \end{pmatrix},$$

where $\bar{I}_{\lambda}(t)$ is SPD estimation 321, and $\bar{x}_{\lambda}$, $\bar{y}_{\lambda}$, $\bar{z}_{\lambda}$ are color matching functions, such as those for the standard CIE 2-degree Standard Observer.

The CPU executes process steps stored in non-volatile RAM 310 in order to implement color primary signal module 324 so as to determine color primary signals 326 for each pixel of the rendered image. In this embodiment, color primary signal module 324 uses all of multiplier 344, spectral device model offset 342, and multispectral image data 313, such that multispectral image data 313 rendered on the reflective display simulates the appearance of multispectral image data 313 calorimetrically under the current ambient illuminant.

More specifically, in the first case where multispectral image data 313 comprises spectral reflectance factors and the spectral device model is linear, color primary signals 326 for each pixel of the rendered image are determined by the following equation, which accepts the spectral reflectance factors $s(\lambda)$ of multispectral image data 313 in order to generate color primary signals (c, m, y) at the current ambient illuminant:

$$\begin{pmatrix} c \\ m \\ y \end{pmatrix} = M(t)\left\{\begin{pmatrix} s_{400} \\ s_{405} \\ \vdots \\ s_{700} \end{pmatrix} - R_0\right\} \tag{23}$$

where M(t) is defined above, $R_0$ is spectral device model offset 342, and $S_{400}, \ldots, S_{700}$ are the spectral reflectance factors of multispectral image data 313.

In the second case, where the multispectral image data comprises coefficients corresponding to a set of spectral basis functions representing spectral reflectance factors and the spectral device model is linear, the spectral device model and the multiplier 344 are defined as before in the first case. Thus, the spectral device model is characterized by the matrix R and the vector $R_0$ defined in equation (21) above and multiplier 344 is calculated using equation (22) above.

In this second case where the multispectral image data comprises coefficients corresponding to a set of spectral basis functions representing spectral reflectance factors, color primary signals 326 for each pixel of the rendered image are determined by the following equation, which accepts coefficients for spectral reflectance factors and calculates color primary signals (c, m, y) at the current ambient illuminant:

$$\begin{pmatrix} c \\ m \\ y \end{pmatrix} = M(t)\left\{(b_1 \vdots \ldots \vdots b_N)\cdot\begin{pmatrix} s_1 \\ s_2 \\ \vdots \\ s_N \end{pmatrix} - R_0\right\} \tag{24}$$

where M(t) is defined above, $R_0$ is spectral device model offset 342, $b_1, \ldots, b_N$ are the spectral basis functions, and $s_1, \ldots, s_N$ are the coefficients for the spectral reflectance factors of multispectral image data 313.

As noted above with respect to other embodiments, while the subtractive CMY model has been used as an example in the above description, reflective display 300 may also use an additive color model such as the RGB model. It should also be noted that although calorimetric data comprises CIEXYZ data in this illustrative embodiment, any suitable representation of calorimetric data may be used.

Figure 8:
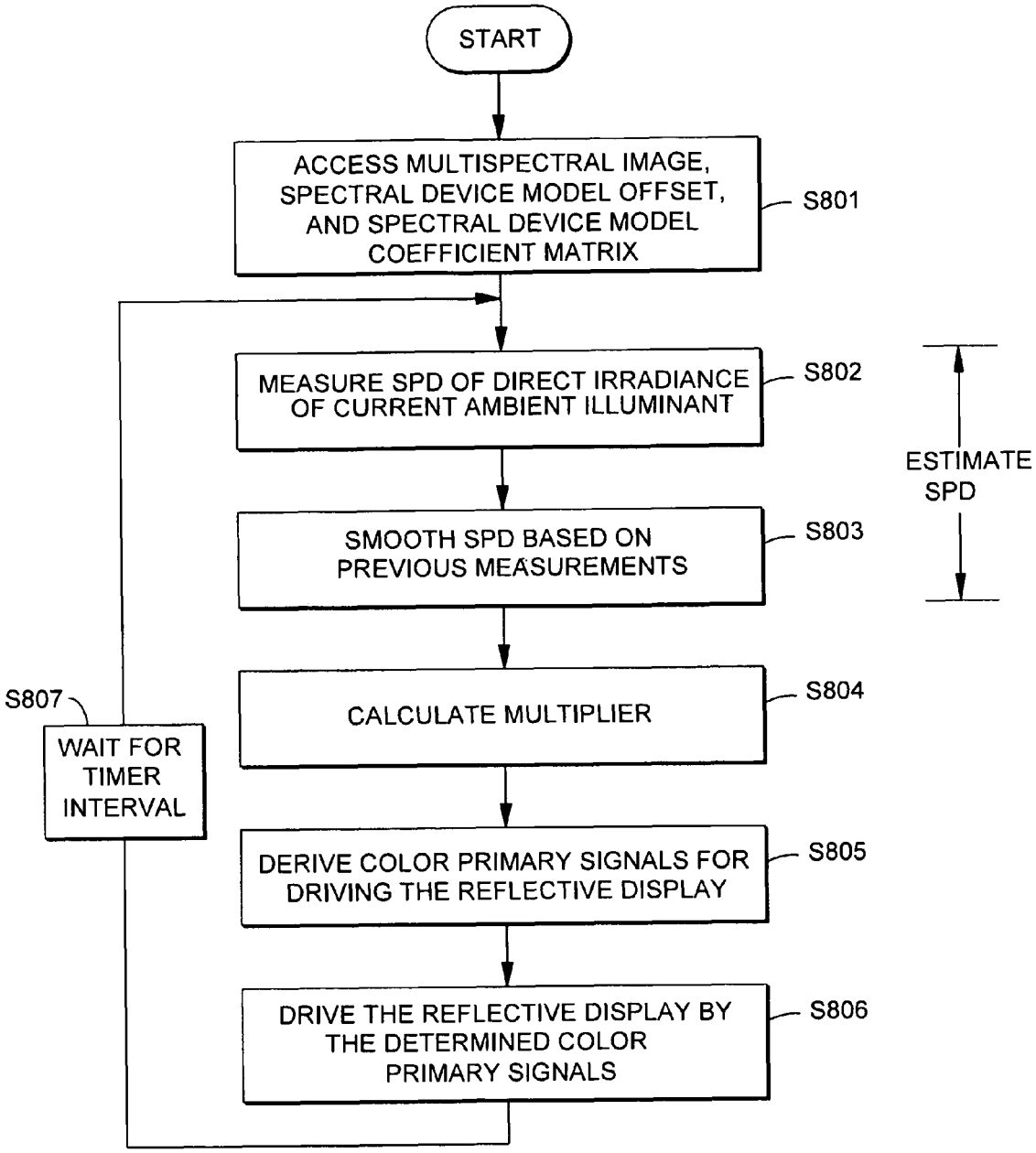
FIG. 8 is a flow diagram for explaining an image display process according to a third example embodiment.

FIG. 8 is a flow diagram for explaining image display on a display apparatus according to the third example embodiment. The process steps shown in FIG. 8 are executed by the CPU based on controller process steps stored in RAM 310. As shown in FIG. 8, at step S801 spectral device model offset 342, spectral device model coefficient matrix 341, and an image containing multispectral image data 313 are accessed.

In steps S802 and S803 an estimation 321 of the SPD of the direct irradiance of the current ambient illuminant is obtained. At step S802, the SPD of the direct irradiance of the current ambient illuminant is measured by measuring device 304. The flow then proceeds to step S803 in which the SPD of the direct irradiance of the current ambient illuminant is temporally smoothed based on previous measurements from measuring device 304.

At step S804 multiplier 344 is calculated at the current ambient illuminant by using SPD estimation 321 and spectral device model coefficient matrix 341. In step S805, color primary signals 326 for driving reflective display 300 are derived by using multiplier 344, spectral device model offset 342, and multispectral image data 313. Color primary signals 326 are determined for each pixel of the image rendered on reflective display 300 corresponding to multispectral image data 313 at the current ambient illuminant.

The process then flows to step S806 in which reflective display 300 is driven by color primary signals 326, such that multispectral image data 313 rendered on reflective display 300 simulates the appearance of multispectral image data 313 under the current ambient illuminant. At the end of step S806, the flow proceeds to step S807, in which display apparatus 350 waits for a time interval determined by timer 315 before returning to step S802, such that color primary signals 326 for driving reflective display 300 are determined based on the cyclic and repetitive estimation 321 of the SPD.

This disclosure has provided a detailed description with respect to particular representative embodiments. It is understood that the scope of the appended claims is not limited to the above-described embodiments and that various changes and modifications may be made without departing from the scope of the claims.

What is claimed is:

1. A display apparatus comprising:

an interface for accessing an image, wherein the image contains multispectral data;

a reflective display driven by color primary signals for corresponding color primaries of the reflective display, wherein the reflective display renders the image by modulation of an ambient illuminant;

a storage device which stores a spectral device model for the reflective display;

a spectral power distribution measuring device to determine a spectral power distribution of a direct irradiance of a current ambient illuminant incident on the reflective display; and a controller to cyclically and repetitively estimate the spectral power distribution of the direct irradiance of the current ambient illuminant by using an output of the spectral power distribution measuring device, and to determine color primary signals for driving the reflective display by using all of the estimation of the spectral power distribution of the direct irradiance of the current ambient illuminant, the spectral device model, and the multispectral image data, such that the multispectral image data rendered on the reflective display simulates the appearance of the multispectral image data calorimetrically under the current ambient illuminant.

2. The apparatus of claim 1, wherein the controller calculates a current calorimetric device model of the reflective display at the current ambient illuminant by using the estimation of the spectral power distribution of the direct irradiance of the current ambient illuminant and the spectral device model, and wherein the controller determines the color primary signals for driving the reflective display by using all of the current calorimetric device model of the reflective display, the estimation of the spectral power distribution of the direct irradiance of the current ambient illuminant, and the multispectral image data.

3. The apparatus of claim 2, wherein the controller calculates current calorimetric image values corresponding to the multispectral image data at the current ambient illuminant by using the estimation of the spectral power distribution of the direct irradiance of the current ambient illuminant and the multispectral image data, wherein an inversion algorithm is applied to the current calorimetric device model of the reflective display to generate a current inverse calorimetric device model of the reflective display, and wherein the controller determines the color primary signals for driving the reflective display by using both of the current inverse calorimetric device model of the reflective display and the current calorimetric image values.

4. The apparatus of claim 3, wherein the current inverse calorimetric device model for the reflective display is calculated only once for the image before being used by the controller to determine the color primary signals for each pixel of the image.

5. The apparatus of claim 1, wherein if the spectral device model is linear and the multispectral data comprises spectral reflectance factors:

the spectral device model is separated into (i) a spectral device model coefficient matrix which is to be used together with the estimation of the spectral power distribution of the direct irradiance of the current ambient illuminant and (ii) a spectral device model offset which is not to be used together with the estimation of the spectral power distribution of the direct irradiance of the current ambient illuminant, wherein the controller calculates a multiplier by using the estimation of the spectral power distribution of the direct irradiance of the current ambient illuminant and the spectral device model coefficient matrix, and wherein the controller determines the color primary signals for driving the reflective display by using all of the multiplier, the spectral device model offset, and the multispectral image data.

6. The apparatus of claim 1, wherein the controller invokes the spectral power distribution measuring device to perform iterative measurements at successive time intervals to generate a time profile of the spectral power distribution of the direct irradiance of the ambient illuminant, and wherein the time profile of the spectral power distribution is used by the controller to determine the estimation of the spectral power distribution of the direct irradiance of the current ambient illuminant.

7. The apparatus of claim 6, wherein a low pass filter in the temporal domain is applied to the time profile of the spectral power distribution to obtain a temporally smoothed spectral power distribution, and wherein the temporally smoothed spectral power distribution is used by the controller as the estimation of the spectral power distribution of the direct irradiance of the current ambient illuminant.

8. The apparatus of claim 1, wherein the spectral power distribution measuring device is provided on or near a housing of the reflective display, such that the spectral power distribution measuring device measures the direct irradiance of the current ambient illuminant incident on the reflective display.

9. The apparatus of claim 1, wherein the spectral power distribution measuring device determines the spectral power distribution of the direct irradiance of the current ambient illuminant at multiple narrow wavelength bands.

10. The apparatus of claim 1, wherein the spectral device model relates multispectral data to the color primary signals driving the reflective display.

11. The apparatus of claim 1, wherein the controller cyclically and repetitively estimates the spectral power distribution of the direct irradiance of the current ambient illuminant at a time interval by using an output of the spectral power distribution measuring device, and wherein the time interval is determined such that changes in the ambient illuminant are detected and flicker of the reflective display is avoided.

12. The apparatus of claim 1, wherein the spectral power distribution measuring device determines the spectral power distribution of the direct irradiance of the current ambient illuminant by sampling the direct irradiance of the current ambient illuminant at a first wavelength sampling interval, wherein the stored multispectral image data is provided at a second wavelength sampling interval, and wherein the first and second wavelength sampling intervals are used to determine a common wavelength sampling interval for both the spectral power distribution and the multispectral image data, if the first wavelength sampling interval is different than the second wavelength sampling interval.

13. The apparatus of claim 1, wherein the reflective display uses a windowing system that displays images in windows, and wherein the multispectral image data to be rendered on the reflective display is provided in one window but not in others of the reflective display.

14. The apparatus of claim 1, wherein the multispectral data comprises spectral reflectance factors.

15. The apparatus of claim 1, wherein the multispectral data comprises bispectral radiance factors.

16. The apparatus of claim 1, wherein the multispectral data comprises coefficients corresponding to a set of spectral basis functions.

17. A method of displaying an image on a reflective display driven by color primary signals for corresponding color primaries of the reflective display, wherein the reflective display renders the image by modulation of an ambient illuminant, the method comprising:

accessing a spectral device model for the reflective display;

accessing the image, wherein the image contains multispectral data;

cyclically and repetitively estimating a spectral power distribution of a direct irradiance of a current ambient illuminant by using a measurement of the spectral power distribution of the direct irradiance of the current ambient illuminant;

determining color primary signals for driving the reflective display by using all of the estimation of the spectral power distribution of the direct irradiance of the current ambient illuminant, the spectral device model, and the multispectral image data; and driving the reflective display by the determined color primary signals, such that the multispectral image data rendered on the reflective display simulates the appearance of the multispectral image data calorimetrically under the current ambient illuminant.

18. The method of claim 17, further comprising:

calculating a current calorimetric device model of the reflective display at the current ambient illuminant by using the estimation of the spectral power distribution of the direct irradiance of the current ambient illuminant and the spectral device model, wherein the color primary signals for driving the reflective display are determined by using all of the current calorimetric device model of the reflective display, the estimation of the spectral power distribution of the direct irradiance of the current ambient illuminant, and the multispectral image data.

19. The method of claim 18, further comprising:

calculating current calorimetric image values corresponding to the multispectral image data at the current ambient illuminant by using the estimation of the spectral power distribution of the direct irradiance of the current ambient illuminant and the multispectral image data; and generating a current inverse calorimetric device model of the reflective display by applying an inversion algorithm to the current calorimetric device model of the reflective display, wherein the color primary signals for driving the reflective display are determined by using both of the current inverse calorimetric device model of the reflective display and the current calorimetric image values.

20. The method of claim 19, wherein the current inverse calorimetric device model for the reflective display is calculated only once for the image before being used to determine the color primary signals for each pixel of the image.

21. The method of claim 17, further comprising:

if the spectral device model is linear and the multispectral data comprises spectral reflectance factors:

separating the spectral device model into (i) a spectral device model coefficient matrix which is to be used together with the estimation of the spectral power distribution of the direct irradiance of the current ambient illuminant and (ii) a spectral device model offset which is not to be used together with the estimation of the spectral power distribution of the direct irradiance of the current ambient illuminant; and calculating a multiplier by using the estimation of the spectral power distribution of the direct irradiance of the current ambient illuminant and the spectral device model coefficient matrix, wherein the color primary signals for driving the reflective display are determined by using all of the multiplier, the spectral device model offset, and the multispectral image data.

22. The method of claim 17, wherein iterative measurements at successive time intervals are performed to generate a time profile of the spectral power distribution of the direct irradiance of the ambient illuminant, and wherein the time profile of the spectral power distribution is used to determine the estimation of the spectral power distribution of the direct irradiance of the current ambient illuminant.

23. The method of claim 22, wherein a low pass filter in the temporal domain is applied to the time profile of the spectral power distribution to obtain a temporally smoothed spectral power distribution, and wherein the temporally smoothed spectral power distribution is used as the estimation of the spectral power distribution of the direct irradiance of the current ambient illuminant.

24. The method of claim 17, wherein the measurement of the spectral power distribution of the direct irradiance of the current ambient illuminant is at multiple narrow wavelength bands.

25. The method of claim 17, wherein the spectral device model relates multispectral data to the color primary signals driving the reflective display.

26. The method of claim 17, wherein the spectral power distribution of the direct irradiance of the current ambient illuminant is cyclically and repetitively estimated at a time interval, and wherein the time interval is determined such that changes in the ambient illuminant are detected and flicker of the reflective display is avoided.

27. The method of claim 17, wherein the estimation of the spectral power distribution of the direct irradiance of the current ambient illuminant is determined by sampling the direct irradiance of the current ambient illuminant at a first wavelength sampling interval, wherein the accessed multispectral image data is provided at a second wavelength sampling interval, and wherein the first and second wavelength sampling intervals are used to determine a common smaller wavelength sampling interval for both the spectral power distribution and the multispectral image data, if the first wavelength sampling interval is different than the second wavelength sampling interval.

28. The method of claim 17, wherein the reflective display uses a windowing system that displays images in windows, and wherein the multispectral image data to be rendered on the reflective display is provided in one window but not in others of the reflective display.

29. The method of claim 17, wherein the multispectral data comprises spectral reflectance factors.

30. The method of claim 17, wherein the multispectral data comprises bispectral radiance factors.

31. The method of claim 17, wherein the multispectral data comprises coefficients corresponding to a set of spectral basis functions.

32. A computer-readable memory medium on which is stored computer-executable process steps for displaying an image on a reflective display driven by color primary signals for corresponding color primaries of the reflective display, wherein the reflective display renders the image by modulation of an ambient illuminant, the process steps comprising:

an accessing step in which a spectral device model for the reflective display is accessed;

an accessing step in which the image is accessed, wherein the image contains multispectral data;

an estimating step in which a spectral power distribution of a direct irradiance of a current ambient illuminant is cyclically and repetitively estimated by using a measurement of the spectral power distribution of the direct irradiance of the current ambient illuminant;

a determining step in which color primary signals for driving the reflective display are determined by using all of the estimation of the spectral power distribution of the direct irradiance of the current ambient illuminant, the spectral device model, and the multispectral image data; and a display driving step in which the reflective display is driven by the determined color primary signals, such that the multispectral image data rendered on the reflective display simulates the appearance of the multispectral image data calorimetrically under the current ambient illuminant.

33. The computer-readable memory medium of claim 32, the process steps further comprising:

calculating a current calorimetric device model of the reflective display at the current ambient illuminant by using the estimation of the spectral power distribution of the direct irradiance of the current ambient illuminant and the spectral device model, wherein the color primary signals for driving the reflective display are determined by using all of the current calorimetric device model of the reflective display, the estimation of the spectral power distribution of the direct irradiance of the current ambient illuminant, and the multispectral image data.

34. The computer-readable memory medium of claim 33, the process steps further comprising:

calculating current calorimetric image values corresponding to the multispectral image data at the current ambient illuminant by using the estimation of the spectral power distribution of the direct irradiance of the current ambient illuminant and the multispectral image data; and generating a current inverse calorimetric device model of the reflective display by applying an inversion algorithm to the current calorimetric device model of the reflective display, wherein the color primary signals for driving the reflective display are determined by using both of the current inverse calorimetric device model of the reflective display and the current calorimetric image values.

35. The computer-readable memory medium of claim 34, wherein the current inverse calorimetric device model of the reflective display is calculated only once for the image before being used to determine the color primary signals for each pixel of the image.

36. The computer-readable memory medium of claim 32, the process steps further comprising:

if the spectral device model is linear and the multispectral data comprises spectral reflectance factors:

separating the spectral device model into (i) a spectral device model coefficient matrix which is to be used together with the estimation of the spectral power distribution of the direct irradiance of the current ambient illuminant and (ii) a spectral device model offset which is not to be used together with the estimation of the spectral power distribution of the direct irradiance of the current ambient illuminant; and calculating a multiplier by using the estimation of the spectral power distribution of the direct irradiance of the current ambient illuminant and the spectral device model coefficient matrix, wherein the color primary signals for driving the reflective display are determined by using all of the multiplier, the spectral device model offset, and the multispectral image data.

37. The computer-readable memory medium of claim 32, wherein iterative measurements at successive time intervals are performed to generate a time profile of the spectral power distribution of the direct irradiance of the ambient illuminant, and wherein the time profile of the spectral power distribution is used to determine the estimation of the spectral power distribution of the direct irradiance of the current ambient illuminant.

38. The computer-readable memory medium of claim 37, wherein a low pass filter in the temporal domain is applied to the time profile of the spectral power distribution to obtain a temporally smoothed spectral power distribution, and wherein the temporally smoothed spectral power distribution is used as the estimation of the spectral power distribution of the direct irradiance of the current ambient illuminant.

39. The computer-readable memory medium of claim 32, wherein the measurement of the spectral power distribution of the direct irradiance of the current ambient illuminant is at multiple narrow wavelength bands.

40. The computer-readable memory medium of claim 32, wherein the spectral device model relates multispectral data to the color primary signals driving the reflective display.

41. The computer-readable memory medium of claim 32, wherein the spectral power distribution of the direct irradiance of the current ambient illuminant is cyclically and repetitively estimated at a time interval in the estimating step, and wherein the time interval is determined such that changes in the ambient illuminant are detected and flicker of the reflective display is avoided.

42. The computer-readable memory medium of claim 32, wherein the estimation of the spectral power distribution of the direct irradiance of the current ambient illuminant is determined by sampling the direct irradiance of the current ambient illuminant at a first wavelength sampling interval, wherein the accessed multispectral image data is provided at a second wavelength sampling interval, and wherein the first and second wavelength sampling intervals are used to determine a common smaller wavelength sampling interval for both the spectral power distribution and the multispectral image data, if the first wavelength sampling interval is different than the second wavelength sampling interval.

43. The computer-readable memory medium of claim 32, wherein the reflective display uses a windowing system that displays images in windows, and wherein the multispectral image data to be rendered on the reflective display is provided in one window but not in others of the reflective display.

44. The computer-readable memory medium of claim 32, wherein the multispectral data comprises spectral reflectance factors.

45. The computer-readable memory medium of claim 32, wherein the multispectral data comprises bispectral radiance factors.

46. The computer-readable memory medium of claim 32, wherein the multispectral data comprises coefficients corresponding to a set of spectral basis functions.

* * * * *